US012710044B2

(12) United States Patent
Cooper

(10) Patent No.: US 12,710,044 B2
(45) **Date of Patent: *Aug. 18, 2026**

(54) AXIAL PUMP AND RISER

(71) Applicant: Molten Metal Equipment Innovations, LLC, Middlefield, OH (US)

(72) Inventor: Paul V. Cooper, Chesterland, OH (US)

(73) Assignee: Molten Metal Equipment Innovations, LLC

( * ) Notice: Subject to any disclaimer, the term of this patent is extended or adjusted under 35 U.S.C. 154(b) by 0 days.

This patent is subject to a terminal disclaimer.

(21) Appl. No.: 18/909,191

(22) Filed: Oct. 8, 2024

(65) Prior Publication Data

US 2025/0027497 A1 Jan. 23, 2025

Related U.S. Application Data

(63) Continuation of application No. 17/826,111, filed on May 26, 2022, now Pat. No. 12,146,508.

(51) Int. Cl.

| | |
|---|---|
| ***F04D 7/00*** | (2006.01) |
| ***B22D 37/00*** | (2006.01) |
| ***F04D 3/00*** | (2006.01) |
| ***F04D 7/06*** | (2006.01) |
| ***F04D 13/06*** | (2006.01) |

(52) U.S. Cl.

CPC ..... *F04D 7/00* (2013.01); *B22D 37/00* (2013.01); *F04D 3/00* (2013.01); *F04D 7/065* (2013.01); *F04D 13/06* (2013.01)

(58) Field of Classification Search

CPC ... F04D 7/00; F04D 3/00; F04D 13/06; B22D 37/00

See application file for complete search history.

(56) References Cited

U.S. PATENT DOCUMENTS

| | | | |
|---|---|---|---|
| 35,604 | A | 6/1862 | Guild |
| 116,797 | A | 7/1871 | Barnhart |
| 209,219 | A | 10/1878 | Bookwalter |
| 251,104 | A | 12/1881 | Finch |
| 307,845 | A | 11/1884 | Curtis |

(Continued)

FOREIGN PATENT DOCUMENTS

| | | |
|---|---|---|
| CA | 683469 | 3/1964 |
| CA | 2115929 | 8/1992 |

(Continued)

*Primary Examiner* — Dominick L Plakkoottam

(74) *Attorney, Agent, or Firm* — SNELL & WILMER L.L.P.

(57) ABSTRACT

A device for pumping molten metal includes a pump configured to pump molten metal, wherein the pump comprises (i) a motor, (ii) a shaft having a first end connected to the motor, and a second end connected to a rotor, wherein the rotor is configured to push molten metal upwards as it rotates. At least part of the shaft and the rotor are positioned in a conduit of a riser. The riser has an outer surface, a front, a bottom, a two-stage conduit, an inlet and an outlet above the inlet and below the motor. The two-stage conduit has a lower stage and a an upper stage, wherein the lower stage is generally cylindrical and the upper stage has a circular cross-sectional portion and one or more lobes extending from and in communication with the circular cross-sectional portion.

16 Claims, 9 Drawing Sheets

(56) References Cited

U.S. PATENT DOCUMENTS 364,804 A 6/1887 Cole
390,319 A 10/1888 Thomson
495,760 A 4/1893 Seitz
506,572 A 10/1893 Wagener
585,188 A 6/1897 Davis
757,932 A 4/1904 Jones
882,477 A 3/1908 Neumann
882,478 A 3/1908 Neumann
890,319 A 6/1908 Wells
898,499 A 9/1908 O'Donnell
909,774 A 1/1909 Flora
919,194 A 4/1909 Livingston
1,037,659 A 9/1912 Rembert
1,100,475 A 6/1914 Franckaerts
1,170,512 A 2/1916 Chapman
1,185,314 A 5/1916 Hedgcock
1,196,758 A 9/1916 Blair
1,304,068 A 5/1919 Krogh
1,331,997 A 2/1920 Neal
1,377,101 A 5/1921 Sparling
1,380,798 A 6/1921 Hansen et al.
1,439,365 A 12/1922 Hazell
1,454,967 A 5/1923 Gill
1,470,607 A 10/1923 Hazell
1,513,875 A 11/1924 Wilke
1,518,501 A 12/1924 Gill
1,522,765 A 1/1925 Wilke
1,526,851 A 2/1925 Hall
1,669,668 A 5/1928 Marshall
1,673,594 A 6/1928 Schmidt
1,697,202 A 1/1929 Nagle
1,717,969 A 6/1929 Goodner
1,718,396 A 6/1929 Wheeler
1,896,201 A 2/1933 Sterner-Rainer
1,988,875 A 1/1935 Saborio
2,013,455 A 9/1935 Baxter
2,035,282 A 3/1936 Schmeller, Sr.
2,038,221 A 4/1936 Kagi
2,075,633 A 3/1937 Anderegg
2,090,162 A 8/1937 Tighe
2,091,677 A 8/1937 Fredericks
2,138,814 A 12/1938 Bressler
2,173,377 A 9/1939 Schultz, Jr. et al.
2,264,740 A 12/1941 Brown
2,280,979 A 4/1942 Rocke
2,290,961 A 7/1942 Heuer
2,300,688 A 11/1942 Nagle
2,304,849 A 12/1942 Ruthman
2,368,962 A 2/1945 Blom
2,383,424 A 8/1945 Stepanoff
2,423,655 A 7/1947 Mars et al.
2,488,447 A 11/1949 Tangen et al.
2,493,467 A 1/1950 Sunnen
2,515,097 A 7/1950 Schryber
2,515,478 A 7/1950 Tooley et al.
2,528,208 A 10/1950 Bonsack et al.
2,528,210 A 10/1950 Stewart
2,543,633 A 2/1951 Lamphere
2,566,892 A 9/1951 Jacobs
2,625,720 A 1/1953 Ross
2,626,086 A 1/1953 Forrest
2,676,279 A 4/1954 Wilson
2,677,609 A 5/1954 Moore et al.
2,698,583 A 1/1955 House et al.
2,714,354 A 8/1955 Farrand
2,762,095 A 9/1956 Pemetzrieder
2,768,587 A 10/1956 Corneil
2,775,348 A 12/1956 Williams
2,779,574 A 1/1957 Schneider
2,787,873 A 4/1957 Hadley
2,808,782 A 10/1957 Thompson et al.
2,809,107 A 10/1957 Russell
2,821,472 A 1/1958 Peterson et al.
2,824,520 A 2/1958 Bartels
2,832,292 A 4/1958 Edwards
2,839,006 A 6/1958 Mayo
2,853,019 A 9/1958 Thornton
2,865,295 A 12/1958 Nikolaus
2,865,618 A 12/1958 Abell
2,868,132 A 1/1959 Rittershofer
2,901,006 A 8/1959 Andrews
2,901,677 A 8/1959 Chessman et al.
2,906,632 A 9/1959 Nickerson
2,918,876 A 12/1959 Howe
2,948,524 A 8/1960 Sweeney et al.
2,958,293 A 11/1960 Pray, Jr.
2,966,345 A 12/1960 Burgoon et al.
2,966,381 A 12/1960 Menzel
2,978,885 A 4/1961 Davison
2,984,524 A 5/1961 Franzen
2,987,885 A 6/1961 Hodge
3,010,402 A 11/1961 King
3,015,190 A 1/1962 Arbeit
3,039,864 A 6/1962 Hess
3,044,408 A 7/1962 Mellott
3,048,384 A 8/1962 Sweeney et al.
3,070,393 A 12/1962 Silverberg et al.
3,092,030 A 6/1963 Wunder
3,099,870 A 8/1963 Seeler
3,128,327 A 4/1964 Upton
3,130,678 A 4/1964 Chenault
3,130,679 A 4/1964 Sence
3,151,565 A 10/1964 Albertson et al.
3,171,357 A 3/1965 Egger
3,172,850 A 3/1965 Englesberg et al.
3,203,182 A 8/1965 Pohl
3,227,547 A 1/1966 Szekely
3,244,109 A 4/1966 Barske
3,251,676 A 5/1966 Johnson
3,255,702 A * 6/1966 Gehrm ..... F04D 7/065
415/217.1
3,258,283 A 6/1966 Winberg et al.
3,272,619 A 9/1966 Sweeney et al.
3,289,473 A 12/1966 Louda
3,291,473 A 12/1966 Sweeney et al.
3,368,805 A 2/1968 Davey et al.
3,374,943 A 3/1968 Cervenka
3,400,923 A 9/1968 Howie et al.
3,417,929 A 12/1968 Secrest et al.
3,432,336 A 3/1969 Langrod et al.
3,459,133 A 8/1969 Scheffler
3,459,346 A 8/1969 Tinnes
3,477,383 A 11/1969 Rawson et al.
3,487,805 A 1/1970 Satterthwaite
3,512,762 A 5/1970 Umbricht
3,512,788 A 5/1970 Kilbane
3,532,445 A 10/1970 Scheffler et al.
3,561,885 A 2/1971 Lake
3,575,525 A 4/1971 Fox et al.
3,581,767 A 6/1971 Jackson
3,612,715 A 10/1971 Yedidiah
3,618,917 A 11/1971 Fredrikson et al.
3,620,716 A 11/1971 Hess
3,650,730 A 3/1972 Derham et al.
3,689,048 A 9/1972 Foulard et al.
3,715,112 A 2/1973 Carbonnel
3,732,032 A 5/1973 Daneel
3,737,304 A 6/1973 Blayden et al.
3,737,305 A 6/1973 Blayden et al.
3,743,263 A 7/1973 Szekely
3,743,500 A 7/1973 Foulard et al.
3,753,690 A 8/1973 Emley et al.
3,759,628 A 9/1973 Kempf
3,759,635 A 9/1973 Carter et al.
3,767,382 A 10/1973 Bruno et al.
3,776,660 A 12/1973 Anderson et al.
3,785,632 A 1/1974 Kraemer et al.
3,787,143 A 1/1974 Carbonnel et al.
3,799,522 A 3/1974 Brant et al.
3,799,523 A 3/1974 Seki
3,807,708 A 4/1974 Jones
3,814,400 A 6/1974 Seki
3,824,028 A 7/1974 Zenkner et al.
3,824,042 A 7/1974 Barnes et al.

(56) References Cited

U.S. PATENT DOCUMENTS 3,836,280 A 9/1974 Koch
3,839,019 A 10/1974 Bruno et al.
3,844,972 A 10/1974 Tully, Jr. et al.
3,871,872 A 3/1975 Downing et al.
3,873,073 A 3/1975 Baum et al.
3,873,305 A 3/1975 Claxton et al.
3,881,039 A 4/1975 Baldieri et al.
3,886,992 A 6/1975 Maas et al.
3,915,594 A 10/1975 Nesseth
3,915,694 A 10/1975 Ando
3,935,003 A 1/1976 Steinke et al.
3,941,588 A 3/1976 Dremann
3,941,589 A 3/1976 Norman et al.
3,942,473 A 3/1976 Chodash
3,954,134 A 5/1976 Maas et al.
3,958,979 A 5/1976 Valdo
3,958,981 A 5/1976 Forberg et al.
3,961,778 A 6/1976 Carbonnel et al.
3,966,456 A 6/1976 Ellenbaum et al.
3,967,286 A 6/1976 Andersson et al.
3,972,709 A 8/1976 Chin et al.
3,973,871 A 8/1976 Hance
3,984,234 A 10/1976 Claxton et al.
3,985,000 A 10/1976 Hartz
3,997,336 A 12/1976 van Linden et al.
4,003,560 A 1/1977 Carbonnel
4,008,884 A 2/1977 Fitzpatrick et al.
4,018,598 A 4/1977 Markus
4,043,146 A 8/1977 Stegherr et al.
4,052,199 A 10/1977 Mangalick
4,055,390 A 10/1977 Young
4,063,849 A 12/1977 Modianos
4,068,965 A 1/1978 Lichti
4,073,606 A 2/1978 Eller
4,091,970 A 5/1978 Komiyama et al.
4,119,141 A 10/1978 Thut et al.
4,125,146 A 11/1978 Muller
4,126,360 A 11/1978 Miller et al.
4,128,415 A 12/1978 van Linden et al.
4,147,474 A 4/1979 Heimdal et al.
4,169,584 A 10/1979 Mangalick
4,191,486 A 3/1980 Pelton
4,213,742 A 7/1980 Henshaw
4,242,039 A 12/1980 Villard et al.
4,244,423 A 1/1981 Thut et al.
4,286,985 A * 9/1981 Van Linden ..... C22B 7/003 266/901
4,305,214 A 12/1981 Hurst
4,322,245 A 3/1982 Claxton
4,338,062 A 7/1982 Neal
4,347,041 A 8/1982 Cooper
4,351,514 A 9/1982 Koch
4,355,789 A 10/1982 Dolzhenkov et al.
4,356,940 A 11/1982 Ansorge
4,360,314 A 11/1982 Pennell
4,370,096 A 1/1983 Church
4,372,541 A 2/1983 Bocourt et al.
4,375,937 A 3/1983 Cooper
4,389,159 A 6/1983 Sarvanne
4,392,888 A 7/1983 Eckert et al.
4,410,299 A 10/1983 Shimoyama
4,419,049 A 12/1983 Gerboth et al.
4,456,424 A 6/1984 Araoka
4,470,846 A 9/1984 Dube
4,474,315 A 10/1984 Gilbert et al.
4,496,393 A 1/1985 Lustenberger
4,504,392 A 3/1985 Groteke
4,509,979 A 4/1985 Bauer
4,530,641 A 7/1985 Gschwender
4,537,624 A 8/1985 Tenhover et al.
4,537,625 A 8/1985 Tenhover et al.
4,545,887 A 10/1985 Amesen
4,556,419 A 12/1985 Otsuka et al.
4,557,766 A 12/1985 Tenhover et al.
4,586,845 A 5/1986 Morris
4,592,700 A 6/1986 Toguchi et al.
4,594,052 A 6/1986 Niskanen
4,596,510 A 6/1986 Arneth et al.
4,598,899 A 7/1986 Cooper
4,600,222 A 7/1986 Appling
4,607,825 A 8/1986 Briolle et al.
4,609,442 A 9/1986 Tenhover et al.
4,611,790 A 9/1986 Otsuka et al.
4,617,232 A 10/1986 Chandler et al.
4,634,105 A 1/1987 Withers et al.
4,640,666 A 2/1987 Sodergard
4,655,610 A 4/1987 Al-Jaroudi
4,668,166 A 5/1987 Lutz
4,669,953 A 6/1987 Gechwender
4,673,434 A 6/1987 Withers et al.
4,682,585 A 7/1987 Hiltebrandt
4,684,281 A 8/1987 Patterson
4,685,822 A 8/1987 Pelton
4,696,703 A 9/1987 Henderson et al.
4,701,226 A 10/1987 Henderson et al.
4,702,768 A 10/1987 Areauz et al.
4,714,371 A 12/1987 Cuse
4,717,540 A 1/1988 McRae et al.
4,739,974 A 4/1988 Mordue
4,741,664 A 5/1988 Olmstead
4,743,428 A 5/1988 McRae et al.
4,747,583 A 5/1988 Gordon et al.
4,767,230 A 8/1988 Leas, Jr.
4,770,701 A 9/1988 Henderson et al.
4,786,230 A 11/1988 Thut
4,802,656 A 2/1989 Hudault et al.
4,804,168 A 2/1989 Otsuka et al.
4,810,314 A 3/1989 Henderson et al.
4,822,473 A 4/1989 Arnesen
4,834,573 A 5/1989 Asano et al.
4,842,227 A 6/1989 Harrington et al.
4,844,425 A 7/1989 Piras et al.
4,851,296 A 7/1989 Tenhover et al.
4,854,834 A 8/1989 Gschwender et al.
4,859,413 A 8/1989 Harris et al.
4,860,819 A 8/1989 Moscoe et al.
4,867,638 A 9/1989 Handtmann et al.
4,884,786 A 12/1989 Gillespie
4,898,367 A 2/1990 Cooper
4,908,060 A 3/1990 Duenkelmann
4,909,704 A 3/1990 Lutz
4,911,726 A 3/1990 Warkentin
4,923,770 A 5/1990 Grasselli et al.
4,930,986 A 6/1990 Cooper
4,931,091 A 6/1990 Waite et al.
4,940,214 A 7/1990 Gillespie
4,940,384 A 7/1990 Amra et al.
4,954,167 A 9/1990 Cooper
4,967,827 A 11/1990 Campbell
4,973,433 A 11/1990 Gilbert et al.
4,986,736 A 1/1991 Kajiwara et al.
4,989,736 A 2/1991 Andersson et al.
5,000,025 A 3/1991 Beekel
5,015,518 A 5/1991 Sasaki et al.
5,025,198 A 6/1991 Mordue et al.
5,028,211 A 7/1991 Mordue et al.
5,029,821 A 7/1991 Bar-on et al.
5,058,654 A 10/1991 Simmons
5,078,572 A * 1/1992 Amra ..... F04D 29/708 415/121.2
5,080,715 A 1/1992 Provencher et al.
5,083,753 A 1/1992 Soofi
5,088,893 A 2/1992 Gilbert et al.
5,092,821 A 3/1992 Gilbert et al.
5,098,134 A 3/1992 Monckton
5,099,554 A 3/1992 Cooper
5,114,312 A 5/1992 Stanislao
5,126,047 A 6/1992 Martin et al.
5,131,632 A 7/1992 Olson
5,135,202 A 8/1992 Yamashita et al.
5,143,357 A 9/1992 Gilbert et al.
5,145,322 A 9/1992 Senior, Jr. et al.
5,152,631 A 10/1992 Bauer
5,154,652 A 10/1992 Ecklesdafer

(56) References Cited

U.S. PATENT DOCUMENTS 5,158,440 A 10/1992 Cooper et al.
5,162,858 A 11/1992 Shoji et al.
5,165,858 A * 11/1992 Gilbert ..... B22D 39/00 415/200
5,177,304 A 1/1993 Nagel
5,191,154 A 3/1993 Nagel
5,192,193 A 3/1993 Cooper et al.
5,202,100 A 4/1993 Nagel et al.
5,203,681 A 4/1993 Cooper
5,209,641 A 5/1993 Hoglund et al.
5,215,448 A 6/1993 Cooper
5,268,020 A 12/1993 Claxton
5,286,163 A 2/1994 Amra et al.
5,298,233 A 3/1994 Nagel
5,301,620 A 4/1994 Nagel et al.
5,303,903 A 4/1994 Butler et al.
5,308,045 A 5/1994 Cooper
5,310,412 A 5/1994 Gilbert et al.
5,318,360 A 6/1994 Langer et al.
5,322,547 A 6/1994 Nagel et al.
5,324,341 A 6/1994 Nagel et al.
5,330,328 A 7/1994 Cooper
5,354,940 A 10/1994 Nagel
5,358,549 A 10/1994 Nagel et al.
5,358,697 A 10/1994 Nagel
5,364,078 A 11/1994 Pelton
5,369,063 A 11/1994 Gee et al.
5,383,651 A 1/1995 Blasen et al.
5,388,633 A 2/1995 Mercer, II et al.
5,395,405 A 3/1995 Nagel et al.
5,399,074 A 3/1995 Nose et al.
5,407,294 A 4/1995 Giannini
5,411,240 A 5/1995 Rapp et al.
5,425,410 A 6/1995 Reynolds
5,431,551 A * 7/1995 Aquino ..... F02B 55/00 418/113
5,435,982 A 7/1995 Wilkinson
5,436,210 A 7/1995 Wilkinson et al.
5,443,572 A 8/1995 Wilkinson et al.
5,454,423 A 10/1995 Tsuchida et al.
5,468,280 A 11/1995 Areaux
5,470,201 A 11/1995 Gilbert et al.
5,484,265 A 1/1996 Horvath et al.
5,489,734 A 2/1996 Nagel et al.
5,491,279 A 2/1996 Robert et al.
5,494,382 A 2/1996 Kloppers
5,495,746 A 3/1996 Sigworth
5,505,143 A 4/1996 Nagel
5,505,435 A 4/1996 Laszlo
5,509,791 A 4/1996 Turner
5,511,766 A 4/1996 Vassilicos
5,520,422 A 5/1996 Friedrich
5,537,940 A 7/1996 Nagel et al.
5,543,558 A 8/1996 Nagel et al.
5,555,822 A 9/1996 Loewen et al.
5,558,501 A 9/1996 Wang et al.
5,558,505 A 9/1996 Mordue et al.
5,571,486 A 11/1996 Robert et al.
5,585,532 A 12/1996 Nagel
5,586,863 A 12/1996 Gilbert et al.
5,591,243 A 1/1997 Colussi et al.
5,597,289 A * 1/1997 Thut ..... F04D 7/065 416/185
5,613,245 A 3/1997 Robert
5,616,167 A 4/1997 Eckert
5,622,481 A 4/1997 Thut
5,629,464 A 5/1997 Bach et al.
5,634,770 A 6/1997 Gilbert et al.
5,640,706 A 6/1997 Nagel et al.
5,640,707 A 6/1997 Nagel et al.
5,640,709 A 6/1997 Nagel et al.
5,655,849 A 8/1997 McEwen et al.
5,660,614 A 8/1997 Waite et al.
5,662,725 A 9/1997 Cooper
5,676,520 A 10/1997 Thut
5,678,244 A 10/1997 Shaw et al.
5,678,807 A 10/1997 Cooper
5,679,132 A 10/1997 Rauenzahn et al.
5,685,701 A 11/1997 Chandler et al.
5,690,888 A 11/1997 Robert
5,695,732 A 12/1997 Sparks et al.
5,716,195 A * 2/1998 Thut ..... F04D 7/065 417/53
5,717,149 A 2/1998 Nagel et al.
5,718,416 A 2/1998 Flisakowski et al.
5,735,668 A 4/1998 Klein
5,735,935 A 4/1998 Areaux
5,741,422 A 4/1998 Eichenmiller et al.
5,744,093 A 4/1998 Davis
5,744,117 A 4/1998 Wilkinson et al.
5,745,861 A 4/1998 Bell et al.
5,755,847 A 5/1998 Quayle
5,758,712 A 6/1998 Pederson
5,772,324 A 6/1998 Falk
5,776,420 A 7/1998 Nagel
5,785,494 A 7/1998 Vild et al.
5,842,832 A 12/1998 Thut
5,846,481 A 12/1998 Tilak
5,858,059 A 1/1999 Abramovich et al.
5,863,314 A 1/1999 Morando
5,866,095 A 2/1999 McGeever et al.
5,875,385 A 2/1999 Stephenson et al.
5,935,528 A 8/1999 Stephenson et al.
5,944,496 A 8/1999 Cooper
5,947,705 A 9/1999 Mordue et al.
5,948,352 A 9/1999 Jagt et al.
5,951,243 A 9/1999 Cooper
5,961,285 A 10/1999 Meneice et al.
5,963,580 A 10/1999 Eckert
5,992,230 A 11/1999 Scarpa et al.
5,993,726 A 11/1999 Huang
5,993,728 A 11/1999 Vild
6,007,313 A 12/1999 Siegel
6,019,576 A 2/2000 Thut
6,027,685 A 2/2000 Cooper
6,036,745 A 3/2000 Gilbert et al.
6,044,858 A * 4/2000 Nathenson ..... F16K 13/10 137/251.1
6,074,455 A 6/2000 van Linden et al.
6,082,965 A 7/2000 Morando
6,093,000 A 7/2000 Cooper
6,096,109 A 8/2000 Nagel et al.
6,113,154 A 9/2000 Thut
6,123,523 A 9/2000 Cooper
6,152,691 A 11/2000 Thut
6,168,753 B1 1/2001 Morando
6,187,096 B1 2/2001 Thut
6,199,836 B1 3/2001 Rexford et al.
6,217,823 B1 4/2001 Vild et al.
6,231,639 B1 5/2001 Eichenmiller
6,250,881 B1 6/2001 Mordue et al.
6,254,340 B1 7/2001 Vild et al.
6,270,717 B1 8/2001 Tremblay et al.
6,280,157 B1 8/2001 Cooper
6,293,759 B1 9/2001 Thut
6,303,074 B1 10/2001 Cooper
6,345,964 B1 2/2002 Cooper
6,354,796 B1 3/2002 Morando
6,358,467 B1 3/2002 Mordue
6,364,930 B1 4/2002 Kos
6,371,723 B1 4/2002 Grant et al.
6,398,525 B1 6/2002 Cooper
6,439,860 B1 8/2002 Greer
6,451,247 B1 9/2002 Mordue et al.
6,457,940 B1 10/2002 Lehman
6,457,950 B1 10/2002 Cooper et al.
6,464,458 B2 10/2002 Vild et al.
6,474,962 B1 11/2002 Allen et al.
6,495,948 B1 12/2002 Garrett, III
6,497,559 B1 12/2002 Grant
6,500,228 B1 12/2002 Klingensmith et al.
6,503,292 B2 1/2003 Klingensmith et al.
6,524,066 B2 2/2003 Thut
6,533,535 B2 3/2003 Thut

(56) References Cited

U.S. PATENT DOCUMENTS 6,551,060 B2 4/2003 Mordue et al.
6,562,286 B1 5/2003 Lehman
6,656,415 B2 12/2003 Kos
6,679,936 B2 1/2004 Quackenbush
6,689,310 B1 2/2004 Cooper
6,709,234 B2 3/2004 Gilbert et al.
6,716,147 B1 4/2004 Hinkle et al.
6,723,276 B1 4/2004 Cooper
6,805,834 B2 10/2004 Thut
6,843,640 B2 1/2005 Mordue et al.
6,848,497 B2 2/2005 Sale et al.
6,869,271 B2 3/2005 Gilbert et al.
6,869,564 B2 3/2005 Gilbert et al.
6,881,030 B2 4/2005 Thut
6,887,424 B2 5/2005 Ohno et al.
6,887,425 B2 5/2005 Mordue et al.
6,902,696 B2 6/2005 Klingensmith et al.
7,037,462 B2 5/2006 Klingensmith et al.
7,074,361 B2 7/2006 Carolla et al.
7,083,758 B2 8/2006 Tremblay
7,131,482 B2 11/2006 Vincent et al.
7,157,043 B2 1/2007 Neff
7,204,954 B2 4/2007 Mizuno
7,273,582 B2 9/2007 Mordue
7,279,128 B2 10/2007 Kennedy et al.
7,326,028 B2 2/2008 Morando
7,402,276 B2 7/2008 Cooper
7,470,392 B2 12/2008 Cooper
7,476,357 B2 * 1/2009 Thut ..... C22B 9/05 266/239
7,481,966 B2 1/2009 Mizuno
7,497,988 B2 3/2009 Thut
7,507,365 B2 3/2009 Thut
7,507,367 B2 3/2009 Cooper
7,543,605 B1 6/2009 Morando
7,731,891 B2 6/2010 Cooper
7,771,171 B2 8/2010 Mohr
7,784,999 B1 * 8/2010 Lott ..... B01F 25/312 137/888
7,841,379 B1 11/2010 Evans
7,896,617 B1 3/2011 Morando
7,906,068 B2 3/2011 Cooper
8,075,837 B2 12/2011 Cooper
8,110,141 B2 2/2012 Cooper
8,137,023 B2 3/2012 Greer
8,142,145 B2 3/2012 Thut
8,178,037 B2 5/2012 Cooper
8,328,540 B2 12/2012 Wang
8,333,921 B2 12/2012 Thut
8,337,746 B2 12/2012 Cooper
8,361,379 B2 1/2013 Cooper
8,366,993 B2 2/2013 Cooper
8,409,495 B2 4/2013 Cooper
8,440,135 B2 5/2013 Cooper
8,444,911 B2 5/2013 Cooper
8,449,814 B2 5/2013 Cooper
8,475,594 B2 7/2013 Bright et al.
8,475,708 B2 7/2013 Cooper
8,480,950 B2 7/2013 Jetten et al.
8,501,084 B2 8/2013 Cooper
8,524,146 B2 9/2013 Cooper
8,529,828 B2 9/2013 Cooper
8,535,603 B2 9/2013 Cooper
8,580,218 B2 11/2013 Turenne et al.
8,613,884 B2 12/2013 Cooper
8,714,914 B2 5/2014 Cooper
8,753,563 B2 6/2014 Cooper
8,840,359 B2 9/2014 Vick et al.
8,899,932 B2 12/2014 Tetkoskie et al.
8,915,830 B2 12/2014 March et al.
8,920,680 B2 12/2014 Mao
9,011,761 B2 4/2015 Cooper
9,017,597 B2 4/2015 Cooper
9,034,244 B2 5/2015 Cooper
9,057,376 B2 6/2015 Thut
9,057,377 B1 6/2015 Thut
9,074,601 B1 * 7/2015 Thut ..... F27D 27/005
9,080,577 B2 7/2015 Cooper
9,108,224 B2 8/2015 Schererz et al.
9,108,244 B2 8/2015 Cooper
9,156,087 B2 * 10/2015 Cooper ..... C22B 21/0084
9,193,532 B2 11/2015 March et al.
9,205,490 B2 12/2015 Cooper
9,234,520 B2 1/2016 Morando
9,273,376 B2 3/2016 Lutes et al.
9,328,615 B2 5/2016 Cooper
9,377,028 B2 6/2016 Cooper
9,382,599 B2 7/2016 Cooper
9,383,140 B2 7/2016 Cooper
9,388,925 B2 7/2016 Juarez
9,409,232 B2 8/2016 Cooper
9,410,744 B2 8/2016 Cooper
9,422,942 B2 8/2016 Cooper
9,435,343 B2 9/2016 Cooper
9,464,636 B2 10/2016 Cooper
9,470,239 B2 10/2016 Cooper
9,476,644 B2 10/2016 Howitt et al.
9,481,035 B2 11/2016 Cooper
9,481,918 B2 11/2016 Vild et al.
9,482,469 B2 11/2016 Cooper
9,494,366 B1 11/2016 Thut
9,506,129 B2 11/2016 Cooper
9,506,346 B2 11/2016 Bright et al.
9,532,670 B2 1/2017 Vanessen
9,566,645 B2 2/2017 Cooper
9,581,388 B2 2/2017 Cooper
9,587,883 B2 3/2017 Cooper
9,632,670 B2 4/2017 Wu
9,643,247 B2 5/2017 Cooper
9,657,578 B2 5/2017 Cooper
9,855,600 B2 1/2018 Cooper
9,862,026 B2 1/2018 Cooper
9,903,383 B2 2/2018 Cooper
9,909,808 B2 3/2018 Cooper
9,920,767 B2 3/2018 Klain et al.
9,925,587 B2 3/2018 Cooper
9,951,777 B2 4/2018 Morando et al.
9,970,442 B2 5/2018 Tipton
9,982,945 B2 5/2018 Cooper
10,052,688 B2 8/2018 Cooper
10,072,897 B2 9/2018 Cooper
10,126,058 B2 11/2018 Cooper
10,126,059 B2 11/2018 Cooper
10,138,892 B2 11/2018 Cooper
10,195,664 B2 2/2019 Cooper et al.
10,267,314 B2 4/2019 Cooper
10,274,256 B2 4/2019 Cooper
10,302,361 B2 5/2019 Cooper
10,307,821 B2 6/2019 Cooper
10,309,725 B2 6/2019 Cooper
10,322,451 B2 6/2019 Cooper
10,345,045 B2 7/2019 Cooper
10,352,620 B2 7/2019 Cooper
10,428,821 B2 10/2019 Cooper
10,458,708 B2 10/2019 Cooper
10,465,688 B2 11/2019 Cooper
10,562,097 B2 2/2020 Cooper
10,570,745 B2 2/2020 Cooper
10,641,270 B2 5/2020 Cooper
10,641,279 B2 5/2020 Cooper
10,675,679 B2 6/2020 Cooper
11,020,798 B2 6/2021 Cooper
11,098,719 B2 8/2021 Cooper
11,098,720 B2 8/2021 Cooper
11,103,920 B2 8/2021 Cooper
11,130,173 B2 9/2021 Cooper
11,149,747 B2 10/2021 Cooper
11,167,345 B2 11/2021 Cooper
11,185,916 B2 11/2021 Cooper
11,286,939 B2 3/2022 Cooper
11,358,216 B2 6/2022 Cooper
11,358,217 B2 6/2022 Cooper
11,391,293 B2 7/2022 Cooper
11,471,938 B2 10/2022 Fontana

(56) References Cited

U.S. PATENT DOCUMENTS 11,519,414 B2 12/2022 Cooper
12,146,508 B2 * 11/2024 Cooper ..... F04D 29/026
2001/0000465 A1 4/2001 Thut
2002/0089099 A1 7/2002 Denning
2002/0102159 A1 8/2002 Thut
2002/0146313 A1 10/2002 Thut
2002/0185789 A1 12/2002 Klingensmith et al.
2002/0185790 A1 12/2002 Kilgensmith
2002/0185794 A1 12/2002 Vincent
2003/0047850 A1 3/2003 Areaux
2003/0075844 A1 4/2003 Mordue et al.
2003/0082052 A1 5/2003 Gilbert et al.
2003/0151176 A1 8/2003 Ohno
2003/0201583 A1 10/2003 Klingensmith
2004/0050525 A1 3/2004 Kennedy et al.
2004/0076533 A1 4/2004 Cooper
2004/0096330 A1 5/2004 Gilbert
2004/0115079 A1 6/2004 Cooper
2004/0245684 A1 12/2004 Kojo
2004/0262825 A1 12/2004 Cooper
2005/0013713 A1 1/2005 Cooper
2005/0013714 A1 1/2005 Cooper
2005/0013715 A1 1/2005 Cooper
2005/0053499 A1 3/2005 Cooper
2005/0077730 A1 4/2005 Thut
2005/0081607 A1 4/2005 Patel et al.
2005/0116398 A1 6/2005 Tremblay
2006/0180963 A1 * 8/2006 Thut ..... F27D 3/14
266/217
2006/0198725 A1 9/2006 Thut
2007/0253807 A1 11/2007 Cooper
2008/0163999 A1 7/2008 Hymas et al.
2008/0202644 A1 8/2008 Grassi
2008/0211147 A1 9/2008 Cooper
2008/0213111 A1 9/2008 Cooper
2008/0230966 A1 9/2008 Cooper
2008/0253905 A1 10/2008 Morando et al.
2008/0304970 A1 12/2008 Cooper
2008/0314548 A1 12/2008 Cooper
2009/0054167 A1 2/2009 Cooper
2009/0140013 A1 6/2009 Cooper
2009/0269191 A1 10/2009 Cooper
2010/0104415 A1 4/2010 Morando
2010/0200354 A1 8/2010 Yagi et al.
2011/0133374 A1 6/2011 Cooper
2011/0135457 A1 6/2011 Cooper
2011/0140318 A1 6/2011 Reeves et al.
2011/0140319 A1 6/2011 Cooper
2011/0140619 A1 6/2011 Lin
2011/0142603 A1 6/2011 Cooper
2011/0142606 A1 6/2011 Cooper
2011/0148012 A1 6/2011 Cooper
2011/0163486 A1 7/2011 Cooper
2011/0210232 A1 9/2011 Cooper
2011/0220771 A1 9/2011 Cooper
2011/0227338 A1 9/2011 Pollack
2011/0303706 A1 12/2011 Cooper
2012/0003099 A1 1/2012 Tetkoskie
2012/0163959 A1 6/2012 Morando
2013/0105102 A1 5/2013 Cooper
2013/0142625 A1 6/2013 Cooper
2013/0214014 A1 8/2013 Cooper
2013/0224038 A1 8/2013 Tetkoskie et al.
2013/0292426 A1 11/2013 Cooper
2013/0292427 A1 11/2013 Cooper
2013/0299524 A1 11/2013 Cooper
2013/0299525 A1 11/2013 Cooper
2013/0306687 A1 11/2013 Cooper
2013/0334744 A1 12/2013 Tremblay
2013/0343904 A1 12/2013 Cooper
2014/0008849 A1 1/2014 Cooper
2014/0041252 A1 2/2014 Vild et al.
2014/0044520 A1 2/2014 Tipton
2014/0083253 A1 3/2014 Lutes et al.
2014/0210144 A1 7/2014 Torres et al.
2014/0232048 A1 8/2014 Howitt et al.
2014/0252697 A1 9/2014 Rauch
2014/0252701 A1 9/2014 Cooper
2014/0261800 A1 9/2014 Cooper
2014/0263482 A1 * 9/2014 Cooper ..... B22D 39/00
222/590
2014/0265068 A1 * 9/2014 Cooper ..... C22B 9/05
266/200
2014/0271219 A1 9/2014 Cooper
2014/0363309 A1 12/2014 Henderson et al.
2015/0069679 A1 3/2015 Henderson et al.
2015/0184311 A1 7/2015 Turenne
2015/0192364 A1 7/2015 Cooper
2015/0217369 A1 8/2015 Cooper
2015/0219111 A1 8/2015 Cooper
2015/0219112 A1 8/2015 Cooper
2015/0219113 A1 8/2015 Cooper
2015/0219114 A1 8/2015 Cooper
2015/0224574 A1 8/2015 Cooper
2015/0252807 A1 9/2015 Cooper
2015/0285557 A1 10/2015 Cooper
2015/0285558 A1 10/2015 Cooper
2015/0323256 A1 11/2015 Cooper
2015/0328682 A1 11/2015 Cooper
2015/0328683 A1 11/2015 Cooper
2016/0031007 A1 2/2016 Cooper
2016/0040265 A1 2/2016 Cooper
2016/0047602 A1 2/2016 Cooper
2016/0053762 A1 2/2016 Cooper
2016/0053814 A1 2/2016 Cooper
2016/0082507 A1 3/2016 Cooper
2016/0089718 A1 3/2016 Cooper
2016/0091251 A1 3/2016 Cooper
2016/0116216 A1 4/2016 Schlicht et al.
2016/0221855 A1 8/2016 Retorick et al.
2016/0250686 A1 9/2016 Cooper
2016/0265535 A1 9/2016 Cooper
2016/0305711 A1 10/2016 Cooper
2016/0320129 A1 11/2016 Cooper
2016/0320130 A1 11/2016 Cooper
2016/0320131 A1 11/2016 Cooper
2016/0346836 A1 12/2016 Henderson et al.
2016/0348973 A1 12/2016 Cooper
2016/0348974 A1 12/2016 Cooper
2016/0348975 A1 12/2016 Cooper
2017/0037852 A1 2/2017 Bright et al.
2017/0038146 A1 2/2017 Cooper
2017/0045298 A1 2/2017 Cooper
2017/0056973 A1 3/2017 Tremblay et al.
2017/0082368 A1 3/2017 Cooper
2017/0106435 A1 4/2017 Vincent
2017/0106441 A1 4/2017 Vincent
2017/0130298 A1 5/2017 Teranishi et al.
2017/0167793 A1 6/2017 Cooper et al.
2017/0198721 A1 7/2017 Cooper
2017/0219289 A1 8/2017 Williams et al.
2017/0241713 A1 8/2017 Henderson et al.
2017/0246681 A1 8/2017 Tipton et al.
2017/0274446 A1 9/2017 Wagstaff
2017/0276430 A1 9/2017 Cooper
2018/0058465 A1 3/2018 Cooper
2018/0111189 A1 4/2018 Cooper
2018/0178281 A1 6/2018 Cooper
2018/0195513 A1 7/2018 Cooper
2018/0311726 A1 11/2018 Cooper
2019/0032675 A1 1/2019 Cooper
2019/0160642 A1 5/2019 Joo et al.
2019/0270134 A1 9/2019 Cooper
2019/0293089 A1 9/2019 Cooper
2019/0351481 A1 11/2019 Tetkoskie
2019/0360491 A1 11/2019 Cooper
2019/0360492 A1 11/2019 Cooper
2019/0368494 A1 12/2019 Cooper
2020/0130050 A1 4/2020 Cooper
2020/0130051 A1 4/2020 Cooper
2020/0130052 A1 4/2020 Cooper
2020/0130053 A1 4/2020 Cooper
2020/0130054 A1 4/2020 Cooper
2020/0182247 A1 6/2020 Cooper

(56) References Cited

U.S. PATENT DOCUMENTS

| | | | |
|---|---|---|---|
| 2020/0182248 | A1 | 6/2020 | Cooper |
| 2020/0256350 | A1 | 8/2020 | Cooper |
| 2020/0360987 | A1 | 11/2020 | Cooper |
| 2020/0360988 | A1 | 11/2020 | Fontana |
| 2020/0360989 | A1 | 11/2020 | Cooper |
| 2020/0360990 | A1 | 11/2020 | Cooper |
| 2020/0362865 | A1 | 11/2020 | Cooper |
| 2020/0363128 | A1 | 11/2020 | Cooper |
| 2021/0199115 | A1 | 7/2021 | Cooper |
| 2021/0254622 | A1 | 8/2021 | Cooper |
| 2022/0025905 | A1 | 1/2022 | Cooper |
| 2022/0080498 | A1 | 3/2022 | Cooper |
| 2022/0193764 | A1 | 6/2022 | Cooper |
| 2022/0213895 | A1 | 7/2022 | Cooper |
| 2022/0234099 | A1 | 7/2022 | Cooper |
| 2022/0381246 | A1 | 12/2022 | Cooper |
| 2023/0001474 | A1 | 1/2023 | Cooper |
| 2023/0219132 | A1 | 7/2023 | Cooper |

FOREIGN PATENT DOCUMENTS

| | | |
|---|---|---|
| CA | 2244251 | 6/1998 |
| CA | 2305865 | 2/2000 |
| CA | 2176475 | 7/2005 |
| CA | 2924572 | 4/2015 |
| CH | 392268 | 9/1965 |
| CN | 102943761 | 2/2013 |
| CN | 103511331 | 1/2014 |
| DE | 1800446 | 12/1969 |
| DE | 19541093 | 5/1997 |
| DE | 19614350 | 10/1997 |
| DE | 102006051814 | 7/2008 |
| EP | 168250 | 1/1986 |
| EP | 665378 | 8/1995 |
| EP | 1019635 | 6/2006 |
| GB | 161707 | 4/1921 |
| GB | 543607 | 3/1942 |
| GB | 942648 | 11/1963 |
| GB | 1185314 | 3/1970 |
| GB | 1565911 | 4/1980 |
| GB | 1575991 | 10/1980 |
| GB | 212260 | 1/1984 |
| GB | 2193257 | 2/1988 |
| GB | 2217784 | 3/1989 |
| GB | 2289919 | 12/1995 |
| JP | 58048796 | 3/1983 |
| JP | 63104773 | 5/1988 |
| JP | 11-270799 | 10/1999 |
| JP | 5112837 | 1/2013 |
| MX | 227385 | 4/2005 |
| NO | 90756 | 1/1959 |
| SU | 416401 | 2/1974 |
| SU | 773312 | 10/1980 |
| WO | 199808990 | 3/1998 |
| WO | 199825031 | 6/1998 |
| WO | 200009889 | 2/2000 |
| WO | 2002012147 | 2/2002 |
| WO | 2004029307 | 4/2004 |
| WO | 2010147932 | 12/2010 |
| WO | 2014031484 | 2/2014 |
| WO | 2014055082 | 4/2014 |
| WO | 2014150503 | 9/2014 |
| WO | 2014185971 | 11/2014 |

* cited by examiner

FIG.8
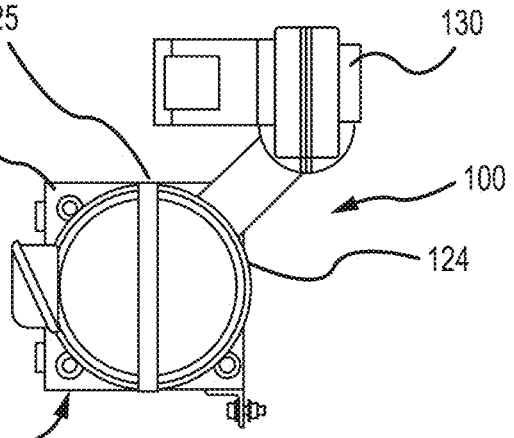
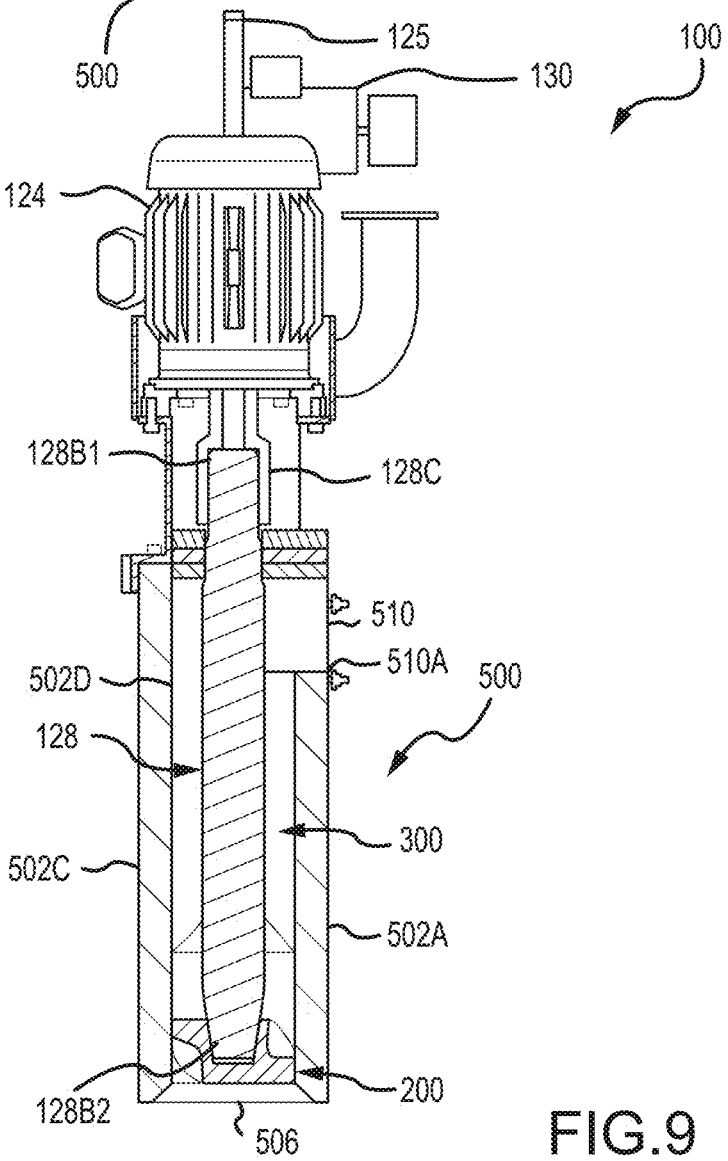
FIG.9

AXIAL PUMP AND RISER

CROSS REFERENCE TO RELATED APPLICATIONS

This is a Continuation of U.S. patent application Ser. No. 17/826,111 filed May 26, 2022 and entitled AXIAL PUMP AND RISER, the contents of which is incorporated by reference in its entirety.

BACKGROUND

As used herein, the term "molten metal" means any metal or combination of metals in liquid form, such as aluminum, copper, iron, zinc, and alloys thereof. The term "gas" means any gas or combination of gases, including argon, nitrogen, chlorine, fluorine, Freon, and helium, which are released into molten metal.

Known molten-metal pumps include a pump base (also called a housing or casing), one or more inlets (an inlet being an opening in the housing to allow molten metal to enter a pump chamber), a pump chamber of any suitable configuration, which is an open area formed within the housing, and a discharge, which is a channel or conduit of any structure or type communicating with the pump chamber (in an axial pump the chamber and discharge may be the same structure or different areas of the same structure) leading from the pump chamber to an outlet, which is an opening formed in the exterior of the housing through which molten metal exits the casing. An impeller, also called a rotor, is mounted in the pump chamber, and is connected to a drive device. The drive shaft is typically an impeller shaft connected to one end of a motor shaft; the other end of the drive shaft being connected to an impeller. Often, the impeller (or rotor) shaft is comprised of graphite and/or ceramic, the motor shaft is comprised of steel, and the two are connected by a coupling. As the motor turns the drive shaft, the drive shaft turns the impeller and the impeller pushes molten metal out of the pump chamber, through the discharge, out of the outlet and into the molten metal bath. Most molten metal pumps are gravity fed, wherein gravity forces molten metal through the inlet and into the pump chamber as the impeller pushes molten metal out of the pump chamber. Other molten metal pumps do not include a base or support posts and are sized to fit into a structure by which molten metal is pumped. Most pumps have a metal platform, or super structure, that is either supported by a plurality of support posts attached to the pump base, or unsupported if there is no base. The motor is positioned on the superstructure if a superstructure is used.

This application incorporates by reference the portions of the following documents that are not inconsistent with this disclosure: U.S. Pat. No. 4,598,899, issued Jul. 8, 1986, to Paul V. Cooper, U.S. Pat. No. 5,203,681, issued Apr. 20, 1993, to Paul V. Cooper, U.S. Pat. No. 5,308,045, issued May 3, 1994, by Paul V. Cooper, U.S. Pat. No. 5,662,725, issued Sep. 2, 1997, by Paul V. Cooper, U.S. Pat. No. 5,678,807, issued Oct. 21, 1997, by Paul V. Cooper, U.S. Pat. No. 6,027,685, issued Feb. 22, 2000, by Paul V. Cooper, U.S. Pat. No. 6,124,523, issued Sep. 26, 2000, by Paul V. Cooper, U.S. Pat. No. 6,303,074, issued Oct. 16, 2001, by Paul V. Cooper, U.S. Pat. No. 6,689,310, issued Feb. 10, 2004, by Paul V. Cooper, U.S. Pat. No. 6,723,276, issued Apr. 20, 2004, by Paul V. Cooper, U.S. Pat. No. 7,402,276, issued Jul. 22, 2008, by Paul V. Cooper, U.S. Pat. No. 7,507,367, issued Mar. 24, 2009, by Paul V. Cooper, U.S. Pat. No. 7,906,068, issued Mar. 15, 2011, by Paul V. Cooper, U.S. Pat. No. 8,075,837, issued Dec. 13, 2011, by Paul V. Cooper, U.S. Pat. No. 8,110,141, issued Feb. 7, 2012, by Paul V. Cooper, U.S. Pat. No. 8,178,037, issued May 15, 2012, by Paul V. Cooper, U.S. Pat. No. 8,361,379, issued Jan. 29, 2013, by Paul V. Cooper, U.S. Pat. No. 8,366,993, issued Feb. 5, 2013, by Paul V. Cooper, U.S. Pat. No. 8,409,495, issued Apr. 2, 2013, by Paul V. Cooper, U.S. Pat. No. 8,440,135, issued May 15, 2013, by Paul V. Cooper, U.S. Pat. No. 8,444,911, issued May 21, 2013, by Paul V. Cooper, U.S. Pat. No. 8,475,708, issued Jul. 2, 2013, by Paul V. Cooper, U.S. patent application Ser. No. 12/895,796, filed Sep. 30, 2010, by Paul V. Cooper, U.S. patent application Ser. No. 12/877,988, filed Sep. 8, 2010, by Paul V. Cooper, U.S. patent application Ser. No. 12/853,238, filed Aug. 9, 2010, by Paul V. Cooper, U.S. patent application Ser. No. 12/880,027, filed Sep. 10, 2010, by Paul V. Cooper, U.S. patent application Ser. No. 13/752,312, filed Jan. 28, 2013, by Paul V. Cooper, U.S. patent application Ser. No. 13/756,468, filed Jan. 31, 2013, by Paul V. Cooper, U.S. patent application Ser. No. 13/791,889, filed Mar. 8, 2013, by Paul V. Cooper, U.S. patent application Ser. No. 13/791,952, filed Mar. 9, 2013, by Paul V. Cooper, U.S. patent application Ser. No. 13/841,594, filed Mar. 15, 2013, by Paul V. Cooper, and U.S. patent application Ser. No. 14/027,237, filed Sep. 15, 2013, by Paul V. Cooper, U.S. Pat. No. 8,535,603 entitled ROTARY DEGASSER AND ROTOR THEREFOR, U.S. Pat. No. 8,613,884 entitled LAUNDER TRANSFER METAL-TRANSFER CONDUIT AND DEVICE, U.S. Pat. No. 8,714,914 entitled MOLTEN METAL PUMP FILTER, U.S. Pat. No. 8,753,563 entitled DEVICE AND METHOD FOR DEGASSING MOLTEN METAL, U.S. Pat. No. 9,011,761 entitled LADLE WITH TRANSFER CONDUIT, U.S. Pat. No. 9,017,597 entitled TRANSFERRING MOLTEN METAL USING NON-GRAVITY ASSIST LAUNDER, U.S. Pat. No. 9,034,244 entitled GAS-TRANSFER FOOT, U.S. Pat. No. 9,080,577 entitled SHAFT AND POST TENSIONING DEVICE, U.S. Pat. No. 9,108,244 entitled IMMERSION HEATHER FOR MOLTEN METAL, U.S. Pat. No. 9,156,087 entitled MOLTEN METAL TRANSFER DEVICE AND ROTOR, U.S. Pat. No. 9,205,490 entitled TRANSFER WELL DEVICE AND METHOD FOR MAKING SAME, U.S. Pat. No. 9,328,615 entitled ROTARY DEGASSERS AND COMPONENTS THEREFOR, U.S. Pat. No. 9,377,028 entitled TENSIONING DEVICE EXTENDING BEYOND COMPONENT, U.S. Pat. No. 9,382,599 entitled ROTARY DEGASSER AND ROTOR THEREFOR, U.S. Pat. No. 9,383,140 entitled TRANSFERRING MOLTEN METAL FROM ONE STRUCTURE TO ANOTHER, U.S. Pat. No. 9,409,232 entitled MOLTEN METAL TRANSFER VESSEL AND METHOD OF CONSTRUCTION, U.S. Pat. No. 9,410,744 entitled VESSEL TRANSFER METAL-TRANSFER CONDUIT AND DEVICE, U.S. Pat. No. 9,422,942 entitled TENSION DEVICE WITH INTERNAL PASSAGE, U.S. Pat. No. 9,435,343 entitled GAS-TRANSFER FOOT, U.S. Pat. No. 9,464,636 entitled TENSION DEVICE GRAPHITE COMPONENT USED IN MOLTEN METAL, U.S. Pat. No. 9,470,239 THREADED TENSIONING DEVICE, U.S. Pat. No. 9,481,035 entitled IMMERSION HEATER FOR MOLTEN METAL, U.S. Pat. No. 9,482,469 entitled VESSEL TRANSFER METAL-TRANSFER CONDUIT AND DEVICE, U.S. Pat. No. 9,506,129 entitled ROTARY DEGASSER AND ROTOR THEREFOR, U.S. Pat. No. 9,566,645 entitled MOLTEN METAL TRANSFER DEVICE AND ROTOR, U.S. Pat. No. 9,581,388 entitled VESSEL TRANSFER METAL-TRANSFER CONDUIT AND DEVICE, U.S. Pat. No. 9,587,883 entitled LADLE WITH TRANSF ER CONDUIT, U.S. Pat. No. 9,643,247 entitled MOLTEN METAL TRANSFER AND DEGASSING DEVICE, U.S. Pat. No. 9,657,578 entitled ROTARY DEGASSERS AND COMPONENTS THEREFOR, U.S. Pat. No. 9,855,600 entitled MOLTEN METAL TRANSFER DEVICE AND ROTOR, U.S. Pat. No. 9,862,026 entitled METHOD OF FORMING TRANSFER WELL, U.S. Pat. No. 9,903,383 entitled MOLTEN METAL ROTOR WITH HARDENED TOP, U.S. Pat. No. 9,909,808 entitled DEVICE AND METHOD FOR DEGASSING MOLTEN METAL, U.S. Pat. No. 9,925,587 entitled METHOD OF TRANSFERRING MOLTEN METAL FROM A VESSEL, entitled U.S. Pat. No. 9,982,945 MOLTEN METAL TRANSFER VESSEL AND METHOD OF CONSTRUCTION, U.S. Pat. No. 10,052,688 entitled TRANSFER PUMP LAUNDER DEVICE, U.S. Pat. No. 10,072,891 entitled TRANSFERRING MOLTEN METAL USING NON-GRAVITY ASSIST LAUNDER, U.S. Pat. No. 10,126,058 entitled MOLTEN METAL TRANSFERRING VESSEL, U.S. Pat. No. 10,126,059 entitled CONTROLLED MOLTEN METAL FLOW FROM TRANSFER VESSEL, U.S. Pat. No. 10,138,892 entitled ROTOR AND ROTOR SHAFT FOR MOLTEN METAL, U.S. Pat. No. 10,195,664 entitled MULTI-STAGE IMPELLER FOR MOLTEN METAL, U.S. Pat. No. 10,267,314 entitled TENSIONED SUPPORT SHAFT AND OTHER MOLTEN METAL DEVICES, U.S. Pat. No. 10,274,256 entitled VESSEL TRANSFER DEVICES AND DEVICES, U.S. Pat. No. 10,302,361 entitled TRANSFER VESSEL FOR MOLTEN METAL PUMPING DEVICE, U.S. Pat. No. 10,309,725 entitled IMMERSION HEATER FOR MOLTEN METAL, U.S. Pat. No. 10,307,821 entitled TRANSFER PUMP LAUNDER DEVICE, 10,322,451 entitled TRANSFER PUMP LAUNDER DEVICE, U.S. Pat. No. 10,345,045 entitled VESSEL TRANSFER METAL-TRANSFER CONDUIT AND DEVICE, U.S. Pat. No. 10,352,620 entitled TRANSFERRING MOLTEN METAL FROM ONE STRUCTURE TO ANOTHER, U.S. Pat. No. 10,428,821 entitled QUICK SUBMERGENCE MOLTEN METAL PUMP, U.S. Pat. No. 10,458,708 entitled TRANSFERRING MOLTEN METAL FROM ONE STRUCTURE TO ANOTHER, U.S. Pat. No. 10,465,688 entitled COUPLING AND ROTOR SHAFT FOR MOLTEN METAL DEVICES, U.S. Pat. No. 10,562,097 entitled MOLTEN METAL TRANSFER DEVICE AND ROTOR, U.S. Pat. No. 10,570,745 entitled ROTARY DEGASSERS AND COMPONENTS THEREFOR, U.S. Pat. No. 10,641,279 entitled MOLTEN METAL ROTOR WITH HARDENED TIP, U.S. Pat. No. 10,641,270 entitled TENSIONED SUPPORT SHAFT AND OTHER MOLTEN METAL DEVICES, U.S. patent application Ser. No. 16/877,267 entitled MOLTEN METAL CONTROLLED FLOW LAUNDER, which was filed on May 18, 2020, U.S. application Ser. No. 16/877,296 entitled SYSTEM AND METHOD TO FEED MOLD WITH MOLTEN METAL, which was filed on May 18, 2020, U.S. application Ser. No. 16/877,332 entitled SMART MOLTEN METAL PUMP, which was filed on May 18, 2020, U.S. application Ser. No. 16/877,182 entitled SYSTEM FOR MELTING SOLID METAL, which was filed on May 18, 2020, U.S. application Ser. No. 16/877,219 entitled METHOD FOR MELTING SOLID METAL, which was filed on May 18, 2020, U.S. Provisional Patent Application Ser. No. 62/849,787 filed on May 17, 2019 and entitled MOLTEN METAL PUMPS, COMPONENTS, DEVICES AND METHODS, and U.S. Provisional Patent Application Ser. No. 62/852,846 filed on May 24, 2019 and entitled SMART MOLTEN METAL PUMP.

Three basic types of pumps for pumping molten metal, such as molten aluminum, are utilized: circulation pumps, transfer pumps and gas-release pumps. Circulation pumps are used to circulate the molten metal within a bath, thereby generally equalizing the temperature of the molten metal. Circulation pumps may be used in any vessel, such as in a reverbatory furnace having an external well. The well is usually an extension of the charging well, in which scrap metal is charged (i.e., added).

Standard transfer pumps are generally used to transfer molten metal from one structure to another structure such as a ladle or another furnace. A standard transfer pump has a riser tube connected to a pump discharge and supported by the superstructure. As molten metal is pumped it is pushed up the riser tube (sometimes called a riser) and out of the riser tube, which generally has an elbow at its upper end, so molten metal is released into a different vessel from which the pump is positioned.

Gas-release pumps, such as gas-injection pumps, circulate molten metal while introducing a gas into the molten metal. In the purification of molten metals, particularly aluminum, it is frequently desired to remove dissolved gases such as hydrogen, or dissolved metals, such as magnesium. As is known by those skilled in the art, the removing of dissolved gas is known as "degassing" while the removal of magnesium is known as "demagging." Gas-release pumps may be used for either of both of these purposes or for any other application for which it is desirable to introduce gas into molten metal.

Gas-release pumps generally include a gas-transfer conduit having a first end that is connected to a gas source and a second end submerged in the molten metal bath. Gas is introduced into the first end and is released from the second end into the molten metal. The gas may be released downstream of the pump chamber into either the pump discharge or a riser extending from the discharge, or into a stream of molten metal exiting either the discharge or the riser. Alternatively, gas may be released into the pump chamber or upstream of the pump chamber at a position where molten metal enters the pump chamber. The gas may also be released into any suitable location in a molten metal bath.

Molten metal pump casings and rotors often employ a bearing device comprising ceramic rings wherein there are one or more rings on the rotor that align with rings in the pump chamber (such as rings at the inlet and outlet) when the rotor is placed in the pump chamber. The purpose of the bearing device is to reduce damage to the soft, graphite components, particularly the rotor and pump base, during pump operation.

Generally, a degasser (also called a rotary degasser) for molten metal, such as molten aluminum, includes (1) an impeller shaft having a first end, a second end and a passage for transferring gas, (2) an impeller, and (3) a drive source for rotating the impeller shaft and the impeller. The first end of the impeller shaft is connected to the drive source and to a gas source and the second end is connected to the impeller.

Generally, a scrap melter for molten metal (particularly molten aluminum) includes an impeller affixed to an end of a drive shaft, and a drive source attached to the other end of the drive shaft for rotating the shaft and the impeller. The movement of the impeller draws molten metal and scrap metal downward into the molten metal bath in order to melt the scrap. A circulation pump is often used in conjunction with the scrap melter to circulate the molten metal in order to maintain a relatively constant temperature within the molten metal.

The materials forming the components that contact the molten metal bath should remain relatively stable in the bath. Structural refractory materials, such as graphite or ceramics, that are resistant to disintegration by corrosive attack from the molten metal may be used. As used herein "ceramics" or "ceramic" refers to any oxidized metal (including silicon, such as silicon dioxide) or carbon-based material, excluding graphite, or other ceramic material capable of being used in a molten metal. "Graphite" means any type of graphite, whether or not chemically treated. Graphite is suitable for being formed into pump components because it is (a) soft and relatively easy to machine, (b) not as brittle as ceramics and less prone to breakage, and (c) less expensive than ceramics. Ceramic, however, is more resistant to corrosion by molten aluminum than graphite.

Some devices or systems used to transfer molten metal include a molten metal pump and a molten riser (or riser). The molten metal pump may have a pump base with a pump chamber in which a rotor is positioned, and a discharge that extends from the pump chamber to a pump outlet formed in a side of the pump base. The riser has a metal-transfer inlet (or transfer inlet) in fluid communication with the pump outlet. In prior devices there was often a gap between the pump outlet and the transfer inlet so more pump speed was required to raise the level of molten metal in the riser. Alignment of the pump outlet with the transfer inlet of the riser would be an advantage. The better the alignment, the less pressure required from the pump to push molten metal from the outlet of the pump base into the riser, up the passage of the riser, and out of the transfer outlet.

SUMMARY

Disclosed is a device that includes (1) a pump having a rotor configured to push molten metal upwards, and (2) a riser in which the rotor and a rotor shaft are at least partially positioned. The riser has an inner conduit (or "conduit" or "passage"), an inlet at or near the bottom of the riser, and an outlet above the inlet and below the pump motor. The pump rotates the rotor shaft and the rotor, and as molten metal enters the inlet the rotor pushes the molten metal upwards in the conduit until the molten metal exits the outlet. A launder or other structure is preferably connected to the riser outlet so molten metal exiting the outlet enters such a structure and is transferred.

The conduit is two-stage with a lower stage having a first width and that is generally cylindrical. An upper stage is above the lower stage and has a second width that may be the same as the first width or different from the first width. In one embodiment, the upper stage has a cross-section with a substantially circular center and one or more lobes extending from and in communication with the center, wherein the purpose of the one or more lobes is to help prevent the formation of a vortex. If vortex forms it could create turbulence that disrupts the flow of molten metal and draws in air, which can create dross as oxygen mixes with the molten metal.

BRIEF DESCRIPTION OF THE DRAWINGS

FIG. 8 is a top view of the device of FIG. 7.

FIG. 9 is a cross-sectional side view taken along line A-A of FIG. 8.

DETAILED DESCRIPTION

Figure 1:
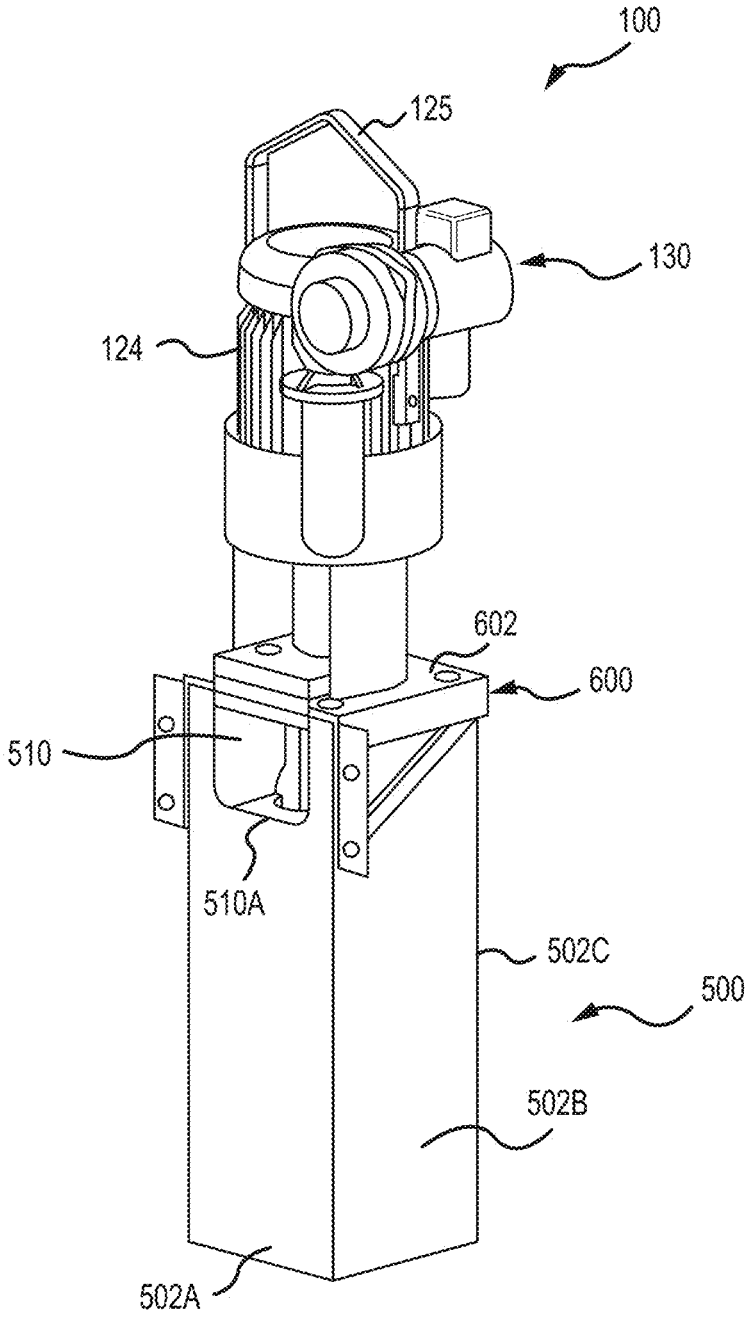
FIG. 1 is a side, perspective view of a device according to this disclosure.

Turning now to the drawings, where the purpose is to describe a preferred embodiment of the invention and not to limit same, a device 10 generally includes a pump 100 and a riser 500.

Pump

As seen, for example, in FIGS. 1-10, pump 100 is of any suitable design (and can be a circulation pump or gas-release pump) satisfactory to move molten metal upwards in conduit 300 of in the riser 500 as described herein. The pump 100 preferably has a pump support (or "support" or "weldment") 122, a drive source 124 (which is most preferably a pneumatic motor) mounted on the support 122, and a drive shaft 128. Motor 124 as shown is secured (at least in part) to support 122 by a strap 125. Motor 124 preferably is partially surrounded by a cooling shroud 131 that circulates air generated by blower 130, which is known in the art.

Drive shaft 128 preferably includes a motor drive shaft 128A that extends downward from the motor 124, a rotor shaft 128B, and a coupling 128C. Motor drive shaft 128A is preferably comprised of steel. Rotor drive shaft (or rotor shaft) 128B is preferably comprised of graphite, or graphite coated with a ceramic, but can be comprised of any suitable material. Coupling 128C is preferably comprised of steel and connects the motor drive shaft 128A to the first end 128B1 of the rotor drive shaft 128B.

Figure 2:
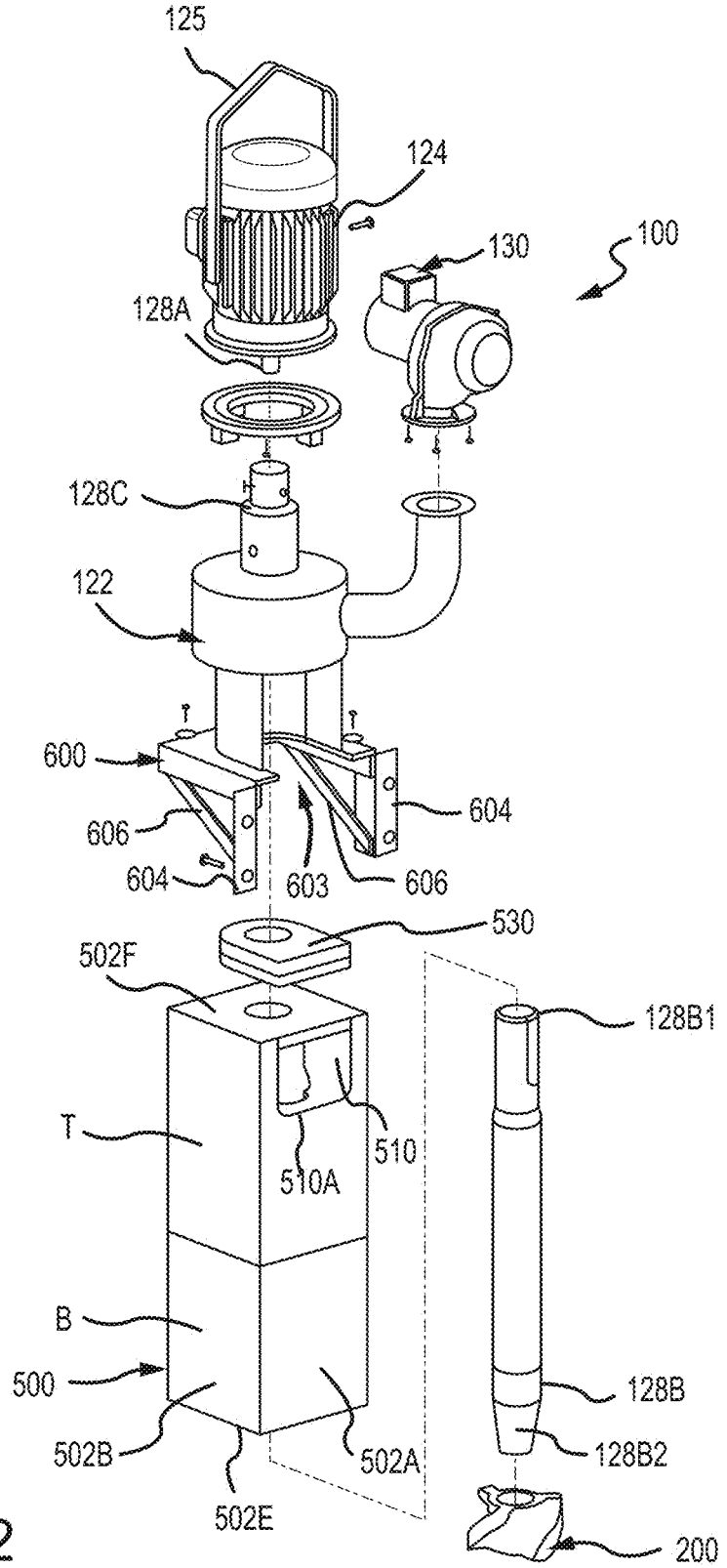
FIG. 2 is a side, perspective, exploded view of the device of FIG. 1.
Figure 3:
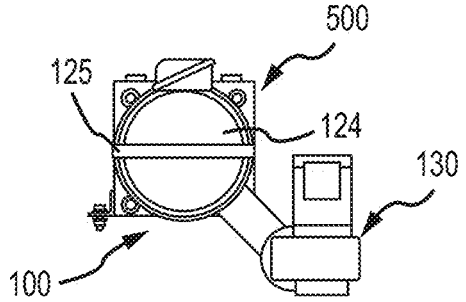
FIG. 3 is a top view of the device of FIG. 1.
Figure 4:
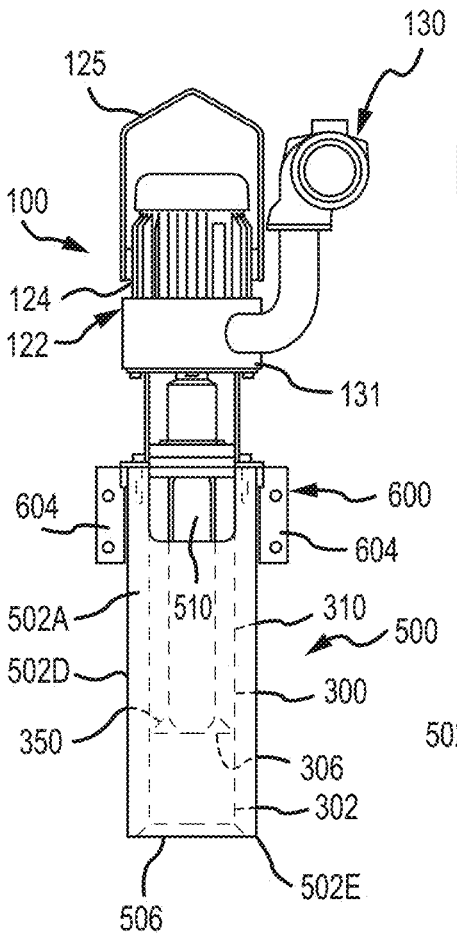
FIG. 4 is a front, partial cross-sectional view of the device of FIG. 1.
Figure 5:
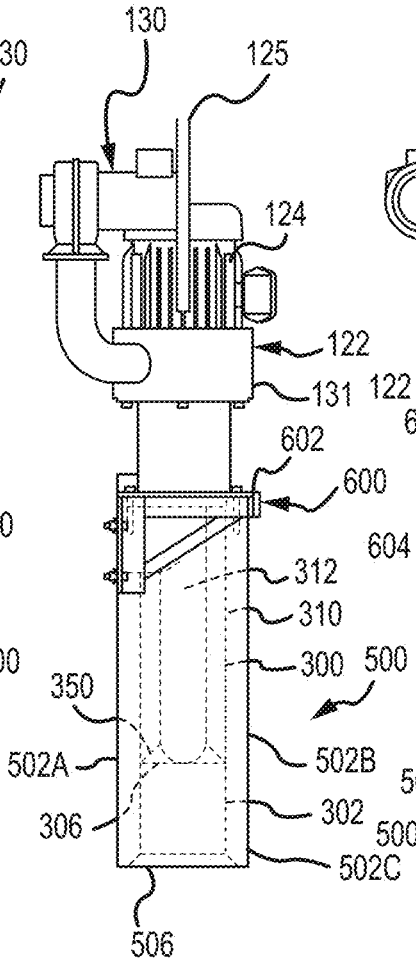
FIG. 5 is a side, partial cross-sectional view of the device of FIG. 1.
Figure 6:
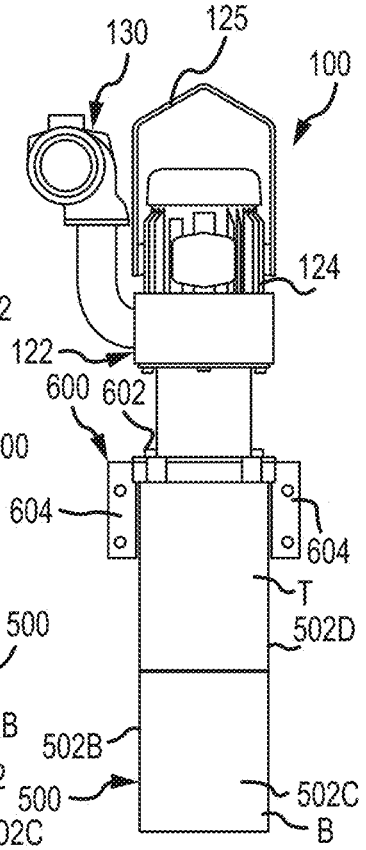
FIG. 6 is a rear view of the device of FIG. 1.
Figure 7:
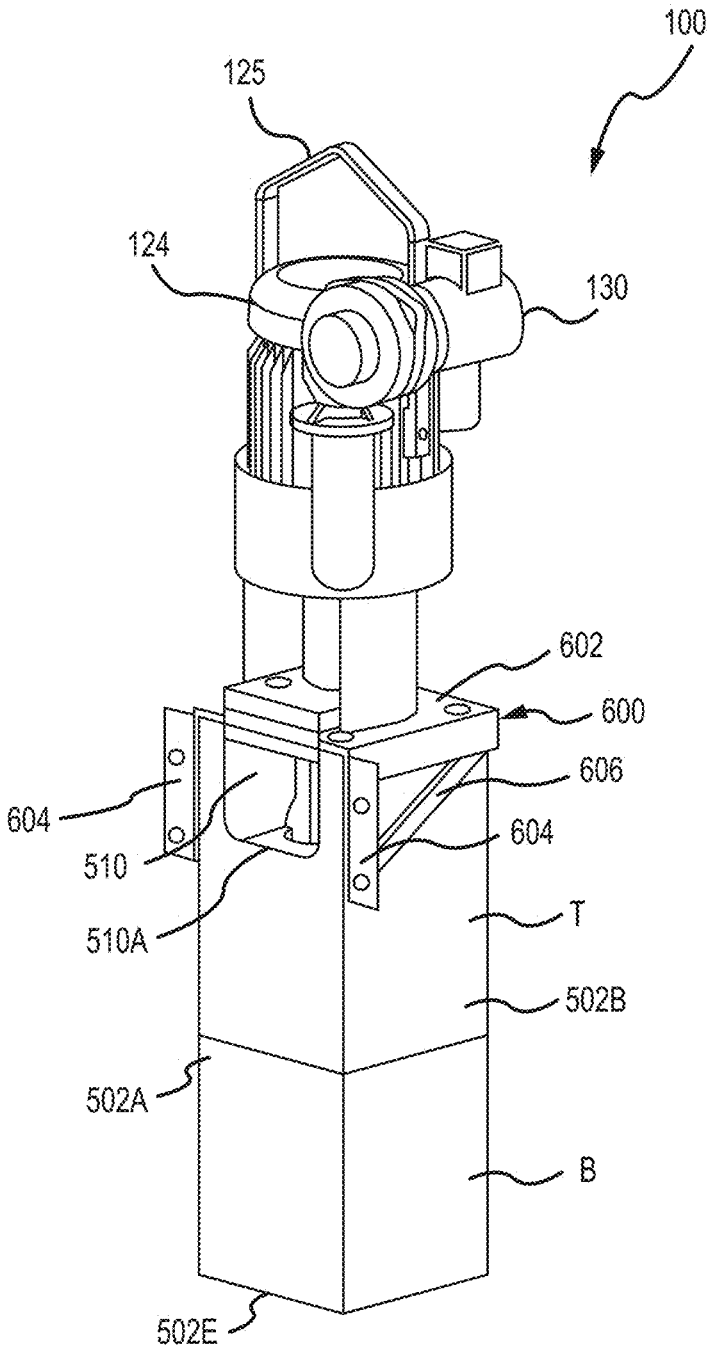
FIG. 7 is a perspective, front view of the device of FIG. 1.
Figure 10:
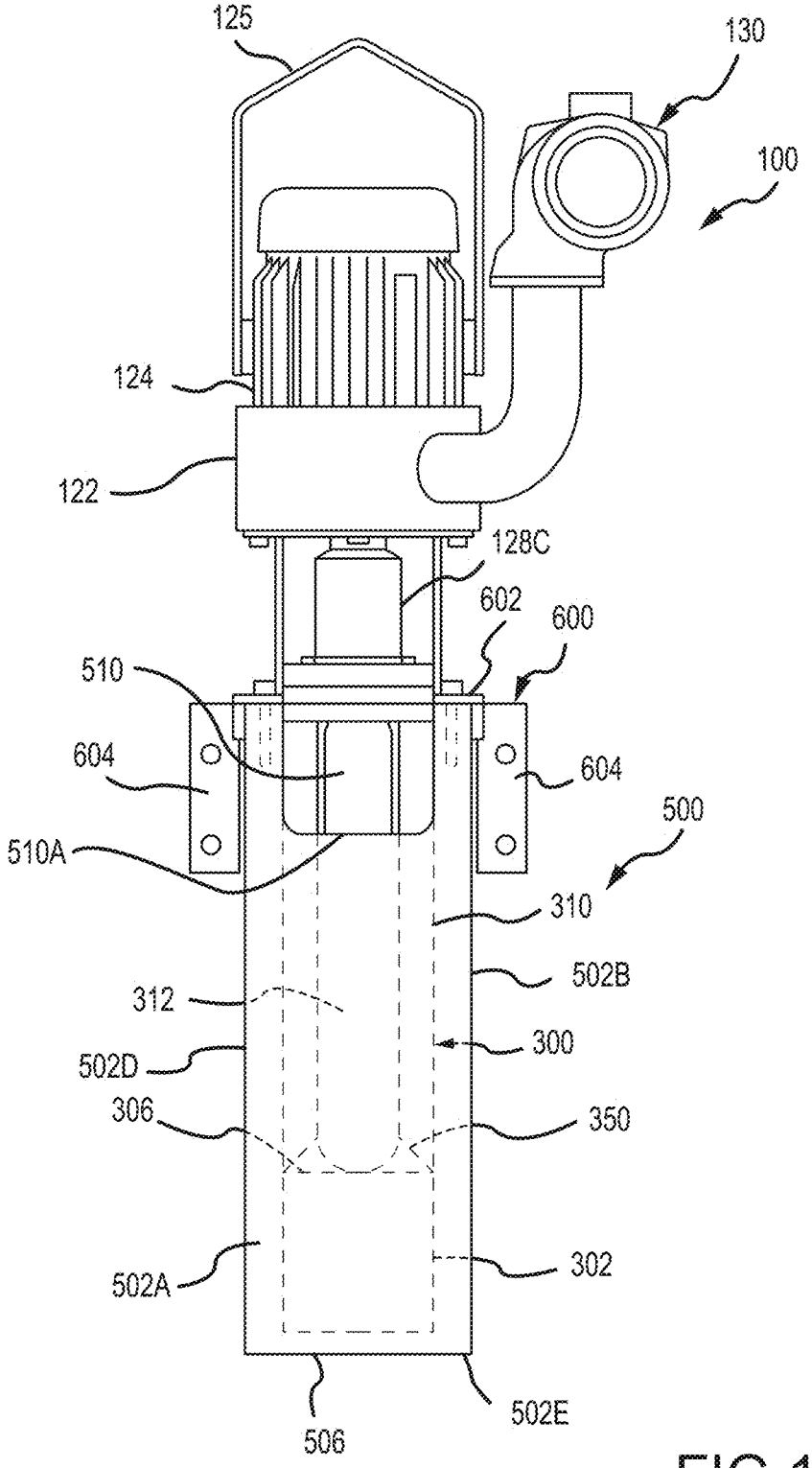
FIG. 10 is a front, partial cross-sectional view of the pump base of FIG. 1.

A rotor 200, best seen in FIG. 2, is positioned in the conduit 300 and is connected to a second end 128B2 of the rotor shaft 128B. Rotor 200 is configured to push molten metal upwards and it may be a two-stage rotor with blades that each include an angled section to push molten metal up into conduit 300.

The components of pump 100 that are immersed in molten metal, such as the rotor 200 and rotor shaft 128, are preferably comprised of graphite and/or ceramic.

Pump 100 as shown has no support posts or pump base.

Riser

Riser 500 is configured to have pump 100 positioned thereon with rotor shaft 128B and rotor 200 positioned at least partially in the conduit 300. Riser 500 as shown is a generally rectangular structure, but can be of any suitable shape or size, wherein the size depends at least in part on the size of the pump with which the riser 500 is used. Outlet 510 is of any suitable size and shape to permit molten metal to pass through it, and is above inlet 506 and below motor 124.

Riser 500 is preferably comprised of material capable of withstanding the heat and corrosive environment of molten metal (particularly molten aluminum). Most preferably the heat resistant material is a high temperature, castable cement, with a high silicon carbide content, such as ones manufactured by AP Green or Harbison Walker, each of which are part of ANH Refractory, based at 400 Fairway Drive, Moon Township, PA 15108, or Allied Materials, and riser 500 is cast or otherwise formed in any suitable manner. Cement (if used) to connect riser 500 to another structure is of a type known by those skilled in the art.

The riser 500 may have a bottom portion B and a top portion T. The bottom portion is preferably comprised of or consists of graphite because graphite is relatively inexpensive and simple to machine. The top portion may be comprised of ceramic such as silicon carbide, which is harder than graphite and also more resistant to corrosion. Alternatively, riser 500 may be comprised entirely of graphite or entirely of ceramic.

Riser 500 as shown has four sides 502A, 502B, 502C and 502D, a bottom 502E a top 502F, an inlet 506, a conduit 300, and an outlet 510.

Inlet 506 functions to allow molten metal to pass through it and into conduit 300. As shown, inlet 506 is formed in bottom 502E, and riser 500 can be raised from the bottom surface of a vessel into which it is positioned in any suitable manner to allow molten metal to enter inlet 506. For example, riser 500 may be suspended or have gaps formed in one or more sides 502A, 502B, 502C, 502D to permit molten metal to enter inlet 506. Alternatively, riser 500 may have support legs or it may rest on a support in order to position bottom 502E above the bottom surface of a vessel in which device 10 is positioned.

Alternatively, inlet 506 may be formed in any of sides 502A, 502B, 502C, or 502D, preferably starting about 0"-2", 2"-6", or 1.5"-3", from bottom surface 502E. If formed in a side surface of riser 500, inlet 506 could have a height of about 2"-4" (or about 3.25") and a width of about 4"-6" (or about 5"). If the inlet 506 is in bottom 502E as shown, it may have a cross-sectional area that is 5%-10%, 10%-20%, 20%-30%, 30%-40%, 40%-50%, or any amount from 5%-50% larger (or smaller) than the cross-sectional area of lower stage 302 of conduit 300. The cross-sectional area of inlet 506 is measured at the outer surface on which it is located, such as the outer surface of bottom 502E. Inlet 506 can be of any suitable size and shape, and as shown flares outward from bottom stage 302 of conduit 300 and is about 3% to 10% wider at bottom 502E than the width of lower stage 302. As shown, inlet 506 has a width at bottom 502E that is greater than 50% of the width, or about 75%-85% the width of bottom 502E as measured along side 502A, 502B, 502C, or 502D.

Insulation 530 is positioned between the pump motor support and the surface 502F of riser 500.

Conduit

Figure 12:
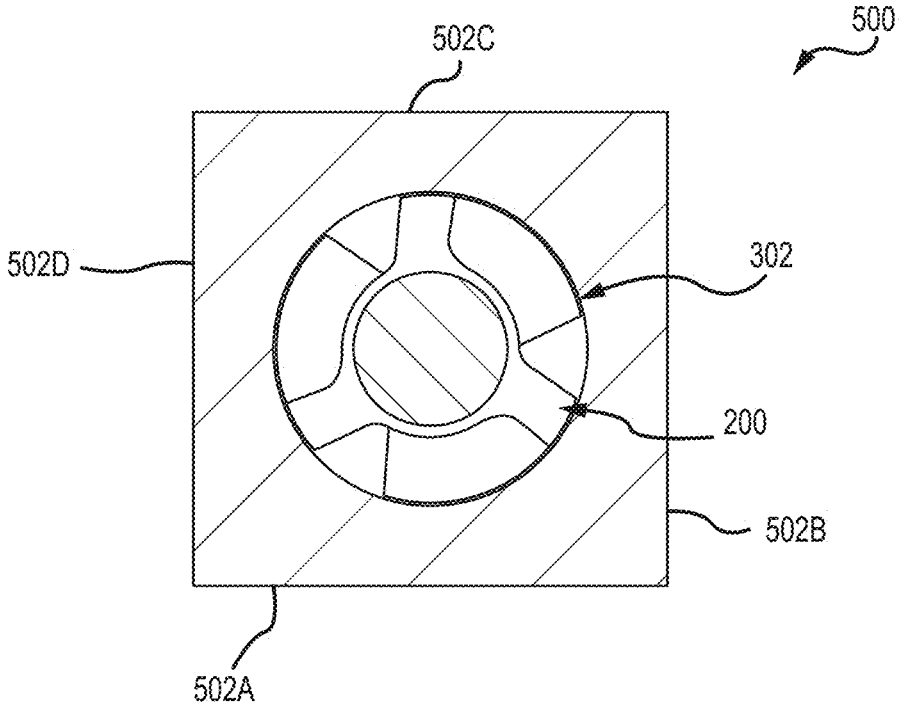
FIG. 12 is a cross-sectional view taken through line C-C of FIG. 10.
Figure 13:
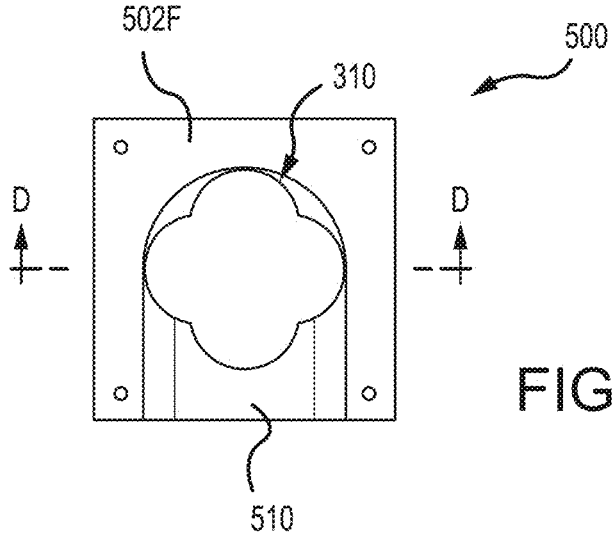
FIG. 13 is a top view of a riser according to this disclosure.
Figure 14:
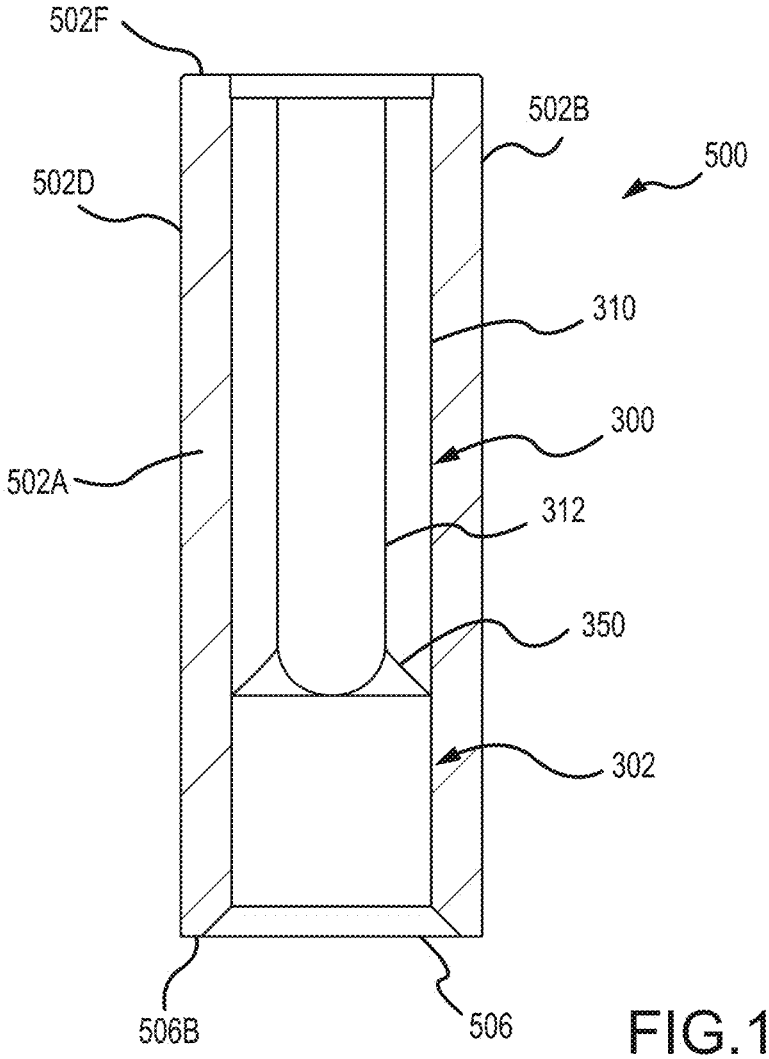
FIG. 14 is a side, cross-sectional view taken along line D-D of FIG. 14.
Figure 15:
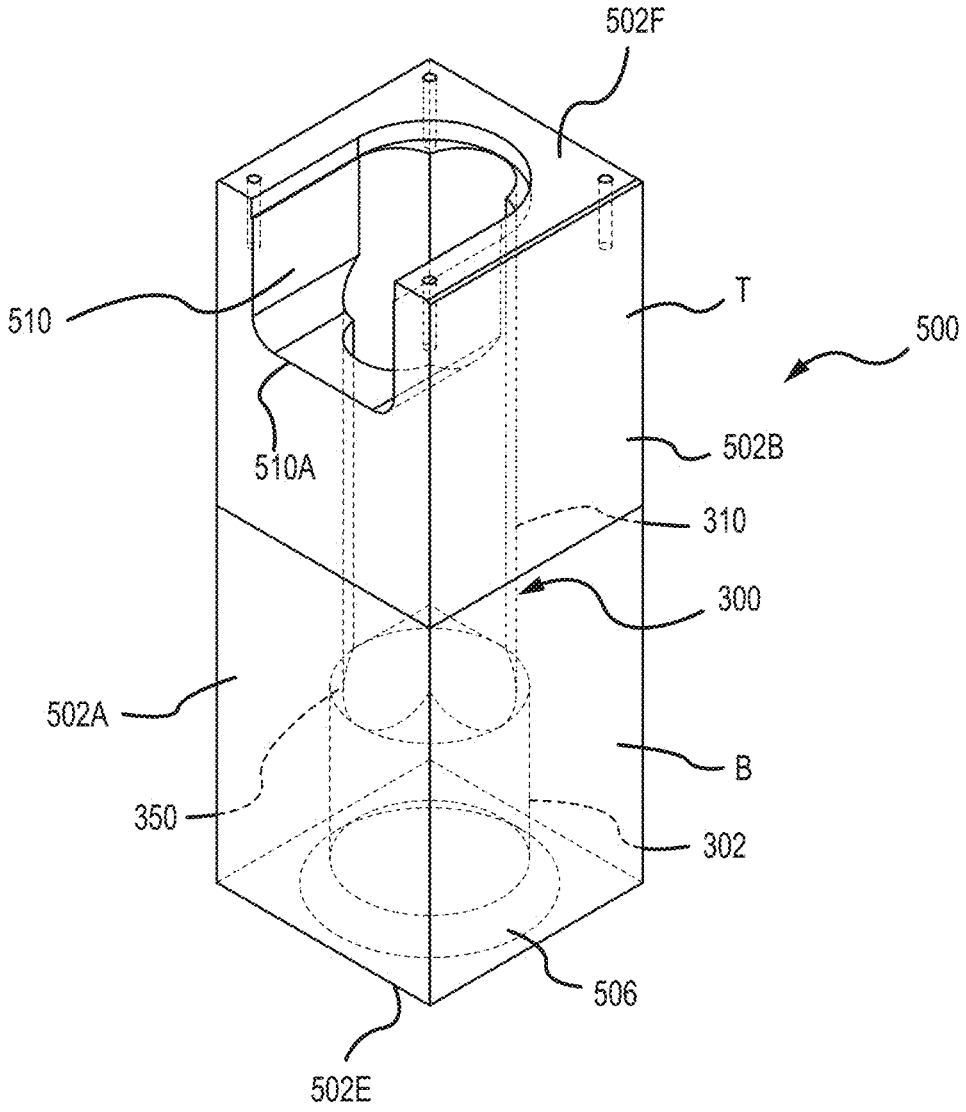
FIG. 15 is a front, perspective, partial cross-sectional view of the riser of FIGS. 13 and 14.

Conduit 300 has two stages, lower stage 302 and upper stage 310, and a transition 350 that connects lower stage 302 and upper stage 310. Lower stage 302 is preferably cylindrical and has a circular cross section (as shown, for example, in FIG. 12), although lower stage 302 could be of any suitable shape. Lower stage 302 has a cross-sectional diameter that as shown is greater than ½ the width of riser 300, and it can be between 30%-70%, or 40%-75%, or 50% or more, or 60% or more of the width of riser 500. Lower stage 302 has a bottom 304 that connects to and communicates with inlet 506 and a top 306 that connects to and communicates with transition 350. As shown, lower stage 302 has a height of about 25%-35% of the height of riser 500 and about 30%-40% of the height of conduit 300, although lower stage 302 could be of any suitable height. Conduit 300's height is measured from bottom 304 to the lower lip 510A of outlet 510.

Figure 11:
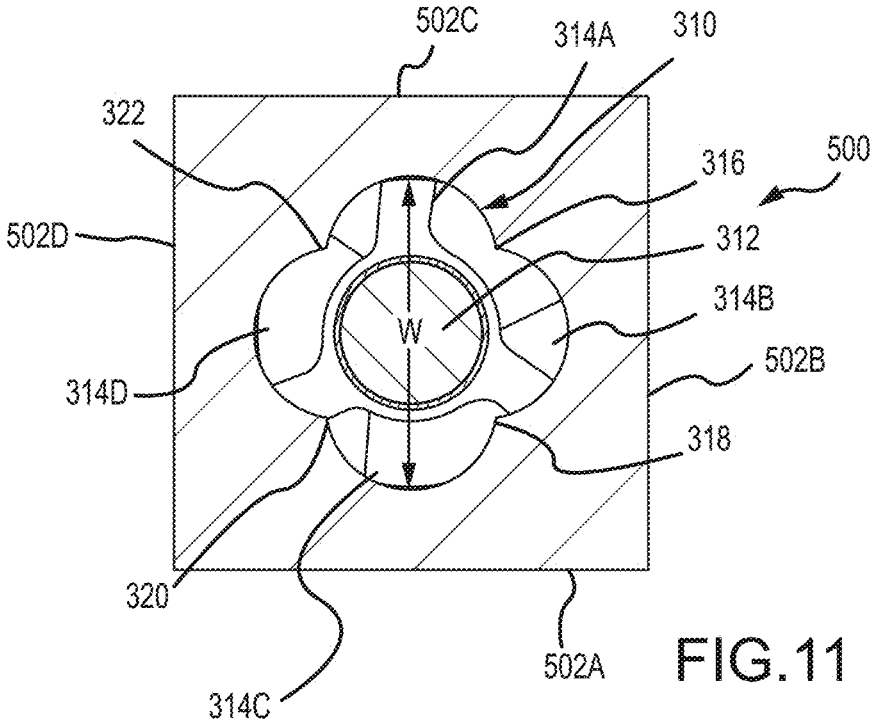
FIG. 11 is a cross-sectional view taken along line B-B of FIG. 10.

Upper stage 310 has a clover-leaf cross-sectional shape (as shown, for example, in FIG. 11). Upper stage 310 includes, in cross section, a circular center 312 and four lobes 314A, 314B, 314C, and 314D, connected to and in communication with circular center 312. The purpose of the lobes is to help prevent a vortex from forming as molten metal is being pumped up through conduit 300.

Although four lobes are shown, one or more lobes, or a plurality of lobes, may be utilized, as long as they are of sufficient number, size and shape to prevent a vortex from forming under normal pump operating parameters.

As shown, the cross-sectional area of lower stage 302 is greater than the cross-sectional area of upper stage 310, although any suitable cross-sectional area for lower stage 302 and upper stage 310 may be utilized. The cross-sectional width W1 of upper stage 310 as measured across lobe 314A and lobe 314C is the same as the cross-sectional width of lower stage 302, although W1 could be any suitable width. The cross-sectional width as measured across lobe 314B and lobe 314D is also W1 and is the same as the cross-sectional width of lower stage 302, although the width as measured across lobes 314B and 314D need not be the same as W1 and need not be the same as the cross-sectional width of lower stage 302.

Each lobe shares a connecting point with an adjacent lobe. Lobe 314A has a connecting point 316 with lobe 314B. Lobe 314B has a connecting point 318 with lobe 314C. Lobe 314C has a connecting point 320 with lobe 314D. Lobe 314D has a connecting point 322 with lobe 314A. As shown, the cross-sectional width from connecting point 316 to connecting point 320 and from connecting point 318 to connecting point 322 are the same, although they need not be the same. Additionally, the cross-sectional width between the connecting points is less than the cross-section width of lower stage 302 and is about 10%, 20%, 30%, 10%-20%, 15%-25%, or 15%-30% less than the cross-sectional width W1, although any suitable width may be used.

Clamp

Clamp 600 is preferably comprised of steel and has a plate 602 having an opening 603 that is configured to be positioned on top surface 502F of riser 500 and be connected thereto by suitable fasteners. Side portions 604 extend downward on side 502A along the sides of outlet 510 and are preferably fastened to side 502A. Cross bars 606 help maintain the stability of clamp 600.

Operation

In operation, when the motor 100 is activated it rotates the rotor shaft 128 and rotor 200. The rotor 200 pumps molten metal upwards through the lower stage 302 of the conduit 300, into the upper stage 310 of the conduit, and out of the outlet 510. The one or more lobes 314A, 314B, 314C, and 314D help to stop a vortex from forming. A vortex can lead to turbulent flow of the molten metal and the formation of dross because the molten metal contacts more air and hence more oxygen. The outlet 510 may be connected to a pipe, launder or other structure that further transfers the molten metal.

Some non-limiting examples of this disclosure are as follows:

Example 1: A device for pumping molten metal, the device comprising:

(a) a pump configured for pumping molten metal, wherein the pump comprises (i) a motor, (ii) a shaft having a first end connected to the motor, and a second end connected to a rotor, wherein the rotor is configured to push molten metal upwards; and (b) a riser having an outer surface, a front, a bottom, an inlet, an outlet above the inlet, and a two-stage conduit having an upper stage comprising a first cross-sectional area and a lower stage beneath the upper stage, wherein the lower stage has a second cross-sectional area that is greater than the first cross-sectional area.

Example 2: The device of example 1, wherein the pump further includes a platform on which the motor is positioned, and the platform is attached to a clamp, and the clamp is further attached to the top portion of the riser.

Example 3: The device of example 1, wherein the bottom portion of the riser is comprised of graphite and the top portion of the riser is comprised of ceramic.

Example 4: The device of example 2, wherein the second cross-sectional area is 25% or more greater than the first cross-sectional area.

Example 5: The device of example 1 that further includes a transition between the upper stage and the lower stage.

Example 6: The device of example 6, wherein the transition expands from the first cross-sectional area where it connects to the upper stage to the second cross-sectional area where it connects to the lower stage.

Example 7: The device of example 6, wherein the transition has a height that is less than a height of the lower stage.

Example 8: The device of example 6, wherein the transition has a height that is less than a height of the upper stage.

Example 9: The device of example 1, wherein the upper stage has a clover-shaped cross section.

Example 10: The device of example 2, wherein the lower stage has a circular cross section.

Example 11: The device of example 2, wherein the upper stage has a cross-section comprising a circular center and a plurality of lobes extending from and connected to the circular center.

Example 12: The device of example 11 that has four lobes.

Example 13: The device of example 11 that has between one and four lobes.

Example 14: The device of example 1, wherein a distance between the outlet and the inlet is 2 feet or more.

Example 15: The device of example 3, wherein the clamp has a plate attached to a top surface of the metal transfer conduit and the clamp is also attached to the platform.

Example 16: The device of example 15, wherein the clamp further includes side arms connected to a side of the riser.

Example 17: The device of example 15, wherein the clamp further includes a step-up section that connects the first plate to the second plate, wherein the step-up section is connected to a side of the platform.

Example 18: The device of example 3, wherein the riser has grooves in two sides and the clamp has side plates with ridges that are received in the grooves.

Example 19: The device of example 11, wherein each of the plurality of lobes has the same size and shape as the other of the plurality of lobes.

Example 20: The device of example 11, wherein each of the plurality of lobes is formed at a 90° angle to the adjacent each of the other plurality of lobes.

Example 21: The device of any one of examples 1-21 that includes insulation between the motor support and the top of the riser.

Example 22: The device of any one of examples 11-13 or 19-20, wherein the center portion of the upper stage of the conduit has a width, and each of the one or more lobes has a width, and the width of the center portion is greater than the width of each of the one or more lobes.

Example 23: The device of any one of examples 11-13, 19-20, or 22, wherein each of the plurality of lobes is spaced equidistantly about the center portion.

Example 24: The device of any one of examples 1-23, wherein the lower stage has a cross-sectional width and the circular portion of the upper stage has a cross-sectional width and the cross-sectional width of the lower stage is greater than the cross-sectional width of the circular portion of the upper stage.

Example 25: The device of example 27, wherein the cross-sectional width of the lower stage is 50%-100% greater than the width of the center portion of the upper stage.

Example 26: The device of any one of examples 1-25, wherein the inlet is in the bottom surface.

Example 27: The device of any one of examples 1-11 or 12-27, wherein the upper stage has at least two lobes in either side of the center portion and a distance between measured between the ends of the lobes, wherein the distance is equal to the cross-sectional width of the lower stage of the conduit.

Having thus described some embodiments of the invention, other variations and embodiments that do not depart from the spirit of the invention will become apparent to those skilled in the art. The scope of the present invention is thus not limited to any particular embodiment, but is instead set forth in the appended claims and the legal equivalents thereof. Unless expressly stated in the written description or claims, the steps of any method recited in the claims may be performed in any order capable of yielding the desired result.

What is claimed is:

1. A device for pumping molten metal, the device comprising:

(a) a pump configured for pumping molten metal, wherein the pump comprises (i) a motor, (ii) a shaft having a first end connected to the motor, and a second end connected to a rotor, wherein the rotor is configured to push molten metal upwards; and (b) a riser having an inlet, an outlet above the inlet, and a conduit, wherein the conduit comprises a cross-section comprising a circular center and a plurality of lobes extending from and connected to the circular center.

2. The device of claim 1, wherein the cross-section comprises four lobes.

3. The device of claim 1, wherein each lobe shares a connecting point with an adjacent lobe.

4. The device of claim 3, wherein the conduit comprises a lower stage conduit and an upper stage conduit, wherein the upper stage conduit comprises the cross-section comprising the circular center and the plurality of lobes, and wherein a cross-sectional width between the connecting points of diametrically opposite lobes is less than a cross-section width of the lower stage conduit.

5. The device of claim 4, wherein the cross-sectional width between the connecting points of diametrically opposite lobes is about 10% to 20% less than the cross-section width of the lower stage conduit.

6. The device of claim 1, wherein each of the plurality of lobes has the same size and shape as the other of the plurality of lobes.

7. The device of claim 1, wherein the conduit comprises at least two lobes on opposing sides of a center portion and a width between the lobes.

8. The device of claim 1, wherein the plurality of lobes help prevent the formation of a vortex.

9. The device of claim 1, wherein each of the plurality of lobes is spaced equidistantly about the center portion.

10. The device of claim 1, wherein the pump further comprises a platform on which the motor is positioned, and the platform is attached to a clamp, and the clamp is further attached to the top of the riser.

11. The device of claim 1, wherein the riser comprises a bottom portion comprised of graphite and a top portion comprised of ceramic.

12. The device of claim 1, wherein the riser comprises a lower stage, an upper stage, and a transition between the upper stage and the lower stage.

13. The device of claim 12, wherein the transition expands from the first cross-sectional area where it connects to the upper stage to the second cross-sectional area where it connects to the lower stage.

14. The device of claim 12, wherein the transition has a height that is less than a height of the lower stage.

15. The device of claim 12, wherein the transition has a height that is less than a height of the upper stage.

16. A device for pumping molten metal, the device comprising:

(a) a pump configured for pumping molten metal, wherein the pump comprises (i) a motor, (ii) a shaft having a first end connected to the motor, and a second end connected to a rotor, wherein the rotor is configured to push molten metal upwards; and (b) a riser comprising an inlet, an outlet above the inlet, and a two-stage inner conduit comprising an upper stage conduit and a lower stage conduit beneath the upper stage conduit, wherein the upper stage conduit comprises a upper stage conduit cross-sectional area of a channel of the upper stage conduit, wherein the lower stage conduit comprises a lower stage conduit cross-sectional area of a channel of the lower stage conduit, wherein the upper stage conduit cross-sectional area is larger than the lower stage conduit cross-sectional area, wherein the two-stage inner conduit comprises a cross-section comprising a circular center and a plurality of lobes extending from and connected to the circular center.

* * * * *